US008042500B2

(12) United States Patent
Tashiro

(10) Patent No.: US 8,042,500 B2
(45) Date of Patent: Oct. 25, 2011

(54) VALVE TRAIN FOR INTERNAL COMBUSTION ENGINE

(75) Inventor: Masahiko Tashiro, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 245 days.

(21) Appl. No.: 12/483,809

(22) Filed: Jun. 12, 2009

(65) Prior Publication Data

US 2009/0308338 A1 Dec. 17, 2009

(30) Foreign Application Priority Data

Jun. 13, 2008 (JP) ..... 2008-155176
Sep. 29, 2008 (JP) ..... 2008-250520

(51) Int. Cl.
*F01L 1/34* (2006.01)

(52) U.S. Cl. ..... 123/90.16; 123/90.39; 123/90.44; 123/90.6; 29/888.1

(58) Field of Classification Search ..... 123/90.16, 123/90.39, 90.44, 90.6; 29/888.1
See application file for complete search history.

(56) References Cited

FOREIGN PATENT DOCUMENTS

JP 62-48105 10/1987

*Primary Examiner* — Ching Chang
(74) *Attorney, Agent, or Firm* — Nelson Mullins Riley & Scarborough LLP; Anthony A. Laurentano

(57) ABSTRACT

A valve train of an internal combustion engine is provided with a plurality of camshaft supports arranged on a support member of the engine, and a camshaft is supported on the camshaft supports. The camshaft has valve operating cams thereon for opening and closing engine valves of engine. A torque reducing mechanism is provided to apply a counter torque to the camshaft to suppress torque fluctuation of the camshaft caused by reaction forces applied to the cams by the engine valves. The torque reducing mechanism has a rotating member that rotates together with the camshaft, and a counterforce applying member for applying a counterforce to the rotating member to apply a counter torque to the camshaft. The counterforce applying member is supported on a connecting member connecting adjacent ones of the camshaft supports. The torque reducing mechanism suppresses torque fluctuation of the camshaft, suppresses increase in the weight of the camshaft, and suppresses increase in the size of the engine, ensuring a necessary supporting rigidity for supporting a counterforce applying mechanism included in the torque reducing mechanism.

11 Claims, 12 Drawing Sheets

VALVE TRAIN FOR INTERNAL COMBUSTION ENGINE

BACKGROUND OF THE INVENTION

1. Technical Field

The present invention relates to a valve train for opening and closing engine valves, namely, intake valves or exhaust valves, of an internal combustion engine. More concretely, the present invention relates to a valve train provided with a torque reducing mechanism for suppressing the fluctuation of torque applied to a camshaft provided with valve-operating cams for opening and closing the valves of an engine.

2. Description of the Related Art

A valve train for an internal combustion engine, disclosed in, for example, JP 62-48105 B includes a camshaft provided with cams for opening and closing valves, and a torque reducing mechanism for applying a counter torque for suppressing torque fluctuation resulting from forces applied to the cams by the valves to the camshaft. The torque reducing mechanism includes a rotating member, such as a counteraction cam which rotates together with the camshaft, and a counterforce applying mechanism for applying counterforce for producing the counter torque to the rotating member.

In the valve train including the camshaft rotatably supported on a cylinder head by a plurality of camshaft supports, wherein the torque reducing mechanism is disposed at a position between two adjacent ones of the camshaft supports, the counterforce applying mechanism is disposed at a position where the camshaft support is to be disposed on the cylinder head, and the rotating member, namely, the counteraction cam, is mounted on a part of the camshaft to be supported by the camshaft support, namely, a journal, to suppress increase in the length of the camshaft. With this arrangement, the rigidity of the camshaft needs to be enhanced to prevent augmentation of the bending deformation of the camshaft resulting from the reduction of the number of the camshaft supports, which causes the weight of the camshaft to increase. The counterforce applied by the counterforce applying mechanism to the rotating member tends to augment the bending deformation still further. In such a case the rigidity of the camshaft needs to be enhanced still further, which increases the weight of the camshaft still further.

When the counterforce applying mechanism of the torque reducing mechanism includes a pressing device for producing a pressing force and a counterforce resulting from the pressing force is applied to the rotating member in the same direction as the pressing force, the counterforce applying mechanism needs to be disposed so as to apply the counterforce in the direction of the pressing force. Therefore, the degree of freedom of arrangement of the counterforce applying mechanism is small and, in some cases, the size of the internal combustion engine in the direction of the pressing force increases.

When the counterforce applying mechanism of the torque reducing mechanism is in contact with the counteraction cam when the camshaft is at an angular position where the torque fluctuates in a narrow range, friction between the counterforce applying mechanism and the counteraction cam increases loss in the torque for rotating the camshaft

SUMMARY OF THE INVENTION

The present invention has been made in view of the foregoing problems and it is therefore an object of the present invention to suppress the fluctuation of the torque applied to a camshaft included in a valve train for an internal combustion engine by a torque reducing mechanism, to suppress increase in the weight of the camshaft caused by the torque reducing mechanism, and to suppress increase in the size of the internal combustion engine ensuring a necessary supporting rigidity for supporting a counterforce applying mechanism included in the torque reducing mechanism.

Another object of the present invention is to enhance torque fluctuation suppressing effect by achieving a simple setting of a proper counter torque for suppressing the fluctuation of torque, to suppress increase in the size of an internal combustion engine resulting from the use of a torque reducing mechanism by increasing the degree of freedom of determining the position of a counterforce applying mechanism included in the torque reducing mechanism, and to reduce the size of the internal combustion engine by properly determining the position of an arm.

A further object of the present invention is to increase the degree of freedom of determining the position of a lever included in a torque reducing mechanism with respect to an axial direction, to arrange the lever and a pressing device included in the torque reducing mechanism in a compact arrangement with respect to a direction perpendicular to the camshaft axial direction as viewed in a direction parallel to the cylinder axis, to improve the effect of sealing the joint between a cylinder head and a cylinder block by the pressing device included in the torque reducing mechanism, to increase the degree of freedom of arranging an intake camshaft torque reducing mechanism and an exhaust camshaft torque reducing mechanism in a space between an intake camshaft and an exhaust camshaft, and to reduce loss in driving torque for rotating the camshafts caused by the torque reducing mechanisms.

To achieve the objects, the present invention provides a valve train for an internal combustion engine, comprising: a plurality of camshaft supports arranged on a support member included in the internal combustion engine; a camshaft supported on the camshaft supports and provided with valve operating cams for opening and closing engine valves included in the internal combustion engine; and a torque reducing mechanism for applying a counter torque to the camshaft to suppress torque fluctuation of the camshaft caused by reaction forces applied to the cams by the engine valves;

wherein the torque reducing mechanism includes a rotating member that rotates together with the camshaft, and a counterforce applying member for applying a counterforce to the rotating member to apply a counter torque to the camshaft; and the counterforce applying member is supported on a connecting member connecting adjacent ones of the camshaft supports.

According to the present invention, in the torque reducing mechanism for suppressing torque fluctuation of the camshaft, the counterforce applying member that applies the counterforce for applying a counter torque for suppressing torque fluctuation to the rotating member attached to the camshaft is supported on the connecting member connecting adjacent ones of the camshaft supports rotatably supporting the camshaft, and hence the counterforce applying member can be held in place without omitting any one of the camshaft supports. Therefore, torque fluctuation applied to the camshaft can be suppressed by the torque reducing mechanism, the camshaft supports can suppress bending deformation of the camshaft, and increase in the weight of the camshaft resulting from the use of the torque reducing mechanism can be avoided. Since the rigidity of the connecting member, namely, a support member supporting the counterforce applying member, is enhanced by the adjacent ones of the camshaft supports, the counterforce applying member can be supported by the connecting member with a necessary rigidity and can effectively avoid increasing the size of the internal combustion engine as compared with the counterforce applying member supported by a support member not connected to any one of the camshaft supports.

In a preferred form of the present invention, the counterforce applying member is a lever supported for rocking on the connecting member, the lever has an input arm and an output arm that rocks together with the input arm, a pressing device is provided to produce a force to be applied to the lever to press the lever against the rotating member, and the pressing device applies the force to the input arm such that the output arm is pressed against the rotating member to apply a counterforce to the rotating member.

In this form of the present invention, the lever supported for rocking on the connecting member has the input arm and the output arm that rock together to apply the counterforce proportional to the force applied by the pressing device to the rotating member. Therefore, the magnitude of the counterforce proportional to the force applied to the input arm and applied by the output arm to the rotating member can be easily changed by changing the leverage of the lever, namely, the ratio of the effective length of the output arm to that of the input arm. Consequently, a proper counter torque for suppressing torque fluctuation can be set by a simple mechanism and the torque fluctuation suppressing effect can be enhanced.

Preferably, the input arm and the output arm are arranged such that the output arm applies the counterforce to the rotating member in a direction different from a direction in which the force is applied to the input arm.

Thus, the rockable lever can apply the counterforce proportional to the force produced by the pressing device to the rotating member in the direction different from the direction of the force. Therefore, the degree of freedom of determining the position of the counterforce applying member increases and increase in the size of the engine resulting from the incorporation of the torque reducing mechanism into the valve train can be suppressed.

Preferably, the adjacent camshaft supports are spaced apart with respect to an axial direction in which the axis of the camshaft extends, the connecting member extends parallel to the axis of the camshaft to connect the adjacent camshaft supports, the connecting member has a support shaft extending between the adjacent camshaft supports, and the lever is supported for rocking on the support shaft.

In a preferred form of the present invention, the adjacent camshaft supports are spaced apart with respect to an axial direction in which the axis of the camshaft extends, a pair of support parts facing each other with respect to the axial direction are formed on the adjacent camshaft supports, respectively, the support shaft is extended between and fixed to the support parts, and the lever is supported for rocking on the support shaft.

In this form of the present invention, the support shaft supporting the lever for rocking connects the adjacent camshaft supports spaced apart with respect to an axial direction in which the axis of the camshaft extends. Therefore, the engine is lighter than an engine in which the adjacent camshaft supports are connected by the connecting member formed integrally with the adjacent camshaft supports in addition to the support shaft supporting the lever, the arrangement of the lever is not subject to restrictions placed by the connecting member. Therefore, the freedom of determining the position of the lever and the degree of freedom of designing the shape of the lever increase, and the torque reducing mechanism and the engine can be formed in small sizes, respectively.

Preferably, the adjacent camshaft supports are spaced apart with respect to the axial direction, two support parts facing each other with respect to the axial direction are formed in the adjacent camshaft supports, respectively, the support shaft is extended between and fixed to the support parts, and the lever is supported for rocking on the support shaft.

Since at least one of the support parts extends toward the other, the space extending in the axial direction between the support parts can be narrowed and hence the rigidity of the support shaft supporting the lever at a position between the support parts can be augmented. A position where the lever is supported on the support shaft can be changed by changing the respective lengths of the protruding parts of the support parts with respect to the axial direction. Thus, the degree of freedom of determining the position of the lever with respect to the axial direction increases.

Preferably, the rotating member and the pressing device overlap at least partly each other with respect to the direction in which the axis of the camshaft extends, the lever rocks about an axis located between the pressing device and the rotating member with respect to a second direction perpendicular to the axis of the camshaft.

The pressing device that that applies a force to the lever, and the rotating member in contact with the lever overlap each other with respect to the second direction perpendicular to the axis of the camshaft, and the axis about which the lever rocks is located in a space between the pressing device and the rotating member with respect to the second direction perpendicular to the axis of the camshaft. Therefore, the lever can be formed in small size in the direction of the axis of the camshaft and the camshaft enables forming the internal combustion engine in small size.

In a preferred form of the present invention, the internal combustion engine has a plurality of cylinders arranged in a direction parallel to the axis of the camshaft, the lever and the pressing device are disposed between the adjacent ones of the cylinders with respect to the direction of the axis of the camshaft, and the pressing device is disposed closer to the cylinders with respect to a direction in which the axes of the cylinders extend than the axis of the camshaft.

Since the support member and the pressing device are disposed between the adjacent ones of the cylinders with respect to the direction of the axis of the camshaft, the lever and the pressing device can be arranged in a space narrow in the direction of the axes of the cylinders so as to avoid interfering with the engine valves. Moreover, since the pressing device is disposed closer to the cylinders with respect to a direction in which the axes of the cylinders extend than the axes of the camshafts, the lever and the pressing device can be arranged near the cylinders in a space narrow in the direction in which the axes of the cylinders extend.

Preferably, the support member is a cylinder head fastened to a cylinder block included in the internal combustion engine with a plurality of fastening bolts, the pressing device is disposed between adjacent fastening bolts and is supported on the cylinder head such that the pressing device presses the cylinder head in a direction in which the fastening bolts apply tightening force to the cylinder head.

Since the pressing device presses the cylinder head in the same direction as the fastening bolts, the effect of sealing the joint between the cylinder head and the cylinder block can be improved by the pressing device of the torque reducing mechanism.

In a practical form of the present invention, a valve train for an internal combustion engine having a support member, comprises: an intake valve and an exhaust valve included in the internal combustion engine; an intake camshaft for opening and closing the intake valve; an exhaust cam shaft for opening and closing the exhaust valve and extending parallel to the intake camshaft; a plurality of intake camshaft supports placed on a support member of the engine and supporting the intake camshaft; a plurality of exhaust camshaft supports placed on the support member of the engine and supporting the exhaust camshaft; an intake camshaft torque reducing mechanism for applying a counter torque for suppressing torque fluctuation of the intake camshaft resulting from reaction forces applied to the intake camshaft by the intake valve; and an exhaust camshaft torque reducing mechanism for applying a counter torque for suppressing torque fluctuation of the exhaust camshaft resulting from reaction forces applied to the exhaust camshaft by the exhaust valve;

wherein the intake camshaft torque reducing mechanism includes an intake rotating member that rotates together with the intake camshaft, and an intake counterforce applying member for applying a counterforce to the intake rotating member to apply a counter torque to the intake camshaft, the intake counterforce applying member is supported by an intake connecting member connecting adjacent ones of the intake camshaft supports forming a pair, the exhaust camshaft torque reducing mechanism includes an exhaust rotating member that rotates together with the exhaust camshaft, and an exhaust counterforce applying member for applying a counterforce to the exhaust rotating member to apply a counter torque to the exhaust camshaft, the exhaust counterforce applying member is supported by an exhaust connecting member connecting the adjacent exhaust camshaft supports forming a pair, the intake camshaft torque reducing mechanism is disposed between the adjacent intake camshaft supports, and the exhaust camshaft torque reducing mechanism is disposed between the adjacent exhaust camshaft supports at positions different from those of the adjacent intake camshaft supports with respect to a direction in which the respective axes of the intake camshaft and the exhaust camshaft extend.

In this practical form of the present invention, the intake and exhaust torque reducing mechanisms are disposed between adjacent intake camshaft supports and between adjacent exhaust camshaft supports, respectively, and the adjacent intake camshaft supports and the adjacent exhaust camshaft supports are at the different positions, respectively, with respect to the axial direction. Therefore, the intake camshaft torque reducing mechanism can be disposed between the positions of the adjacent intake camshaft supports with respect to the axial direction between the intake camshaft and the exhaust camshaft without being restricted by the exhaust camshaft torque reducing mechanism and, similarly, the exhaust camshaft torque reducing mechanism can be disposed between the positions of the adjacent exhaust camshaft supports with respect to the axial direction between the intake camshaft and the exhaust camshaft without being restricted by the intake camshaft torque reducing mechanism. Consequently, the degree of freedom of determining the respective positions of the intake and exhaust camshaft torque reducing mechanisms in a space between the intake camshaft and exhaust camshaft is large, and a high counter torque can be produced with a small force produced by the pressing device by properly determining the leverage of the lever without increasing the size of the engine.

Preferably, the counterforce applying member is pressed against the rotating member to apply counterforce to the rotating member, and the torque reducing mechanism is provided with a stopping means for preventing the counterforce applying member from applying the counterforce to the rotating member when variation of the torque of the camshaft is not greater than a predetermined value.

Thus, the counterforce applying member is prevented from coming into contact with the rotating member so that counter torque is not applied to the camshaft when the torque of the camshaft is fluctuating in a narrow range. Therefore, useless frictional engagement of the counterforce applying member and the rotating member can be avoided and loss in the driving torque for rotating the camshaft attributable to the torque reducing mechanism can be reduced.

Preferably, the camshaft having valve operating cams includes an outer camshaft and an inner camshaft extended in the outer camshaft for rotation relative to the outer camshaft, and the outer and the inner camshaft are connected to phase control mechanisms, respectively. Thus, the phases of the valve operating cams for operating the valves of the engine can be easily controlled.

DESCRIPTION OF THE PREFERRED EMBODIMENTS

Valve trains in preferred embodiments of the present invention will be described with reference to FIGS. 1 to 12.

FIGS. 1 to 6 are views of assistance in explaining a valve train 20 in a first embodiment of the present invention.

Figure 1:
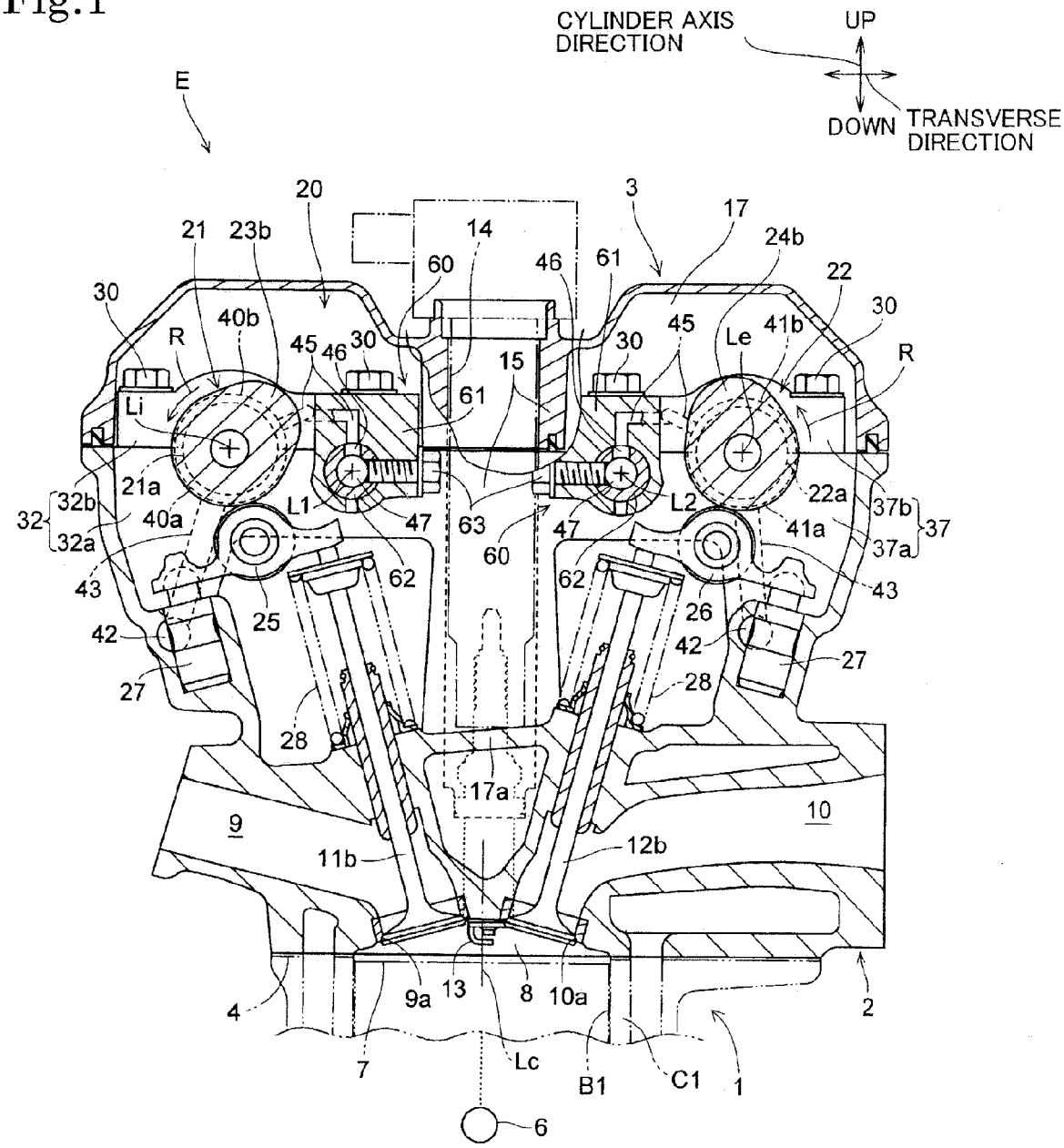
FIG. 1 is a cross-sectional view taken on the line I-I in FIG. 2 of an important part of an internal combustion engine provided with a valve train in a first embodiment of the present invention.
Figure 2:
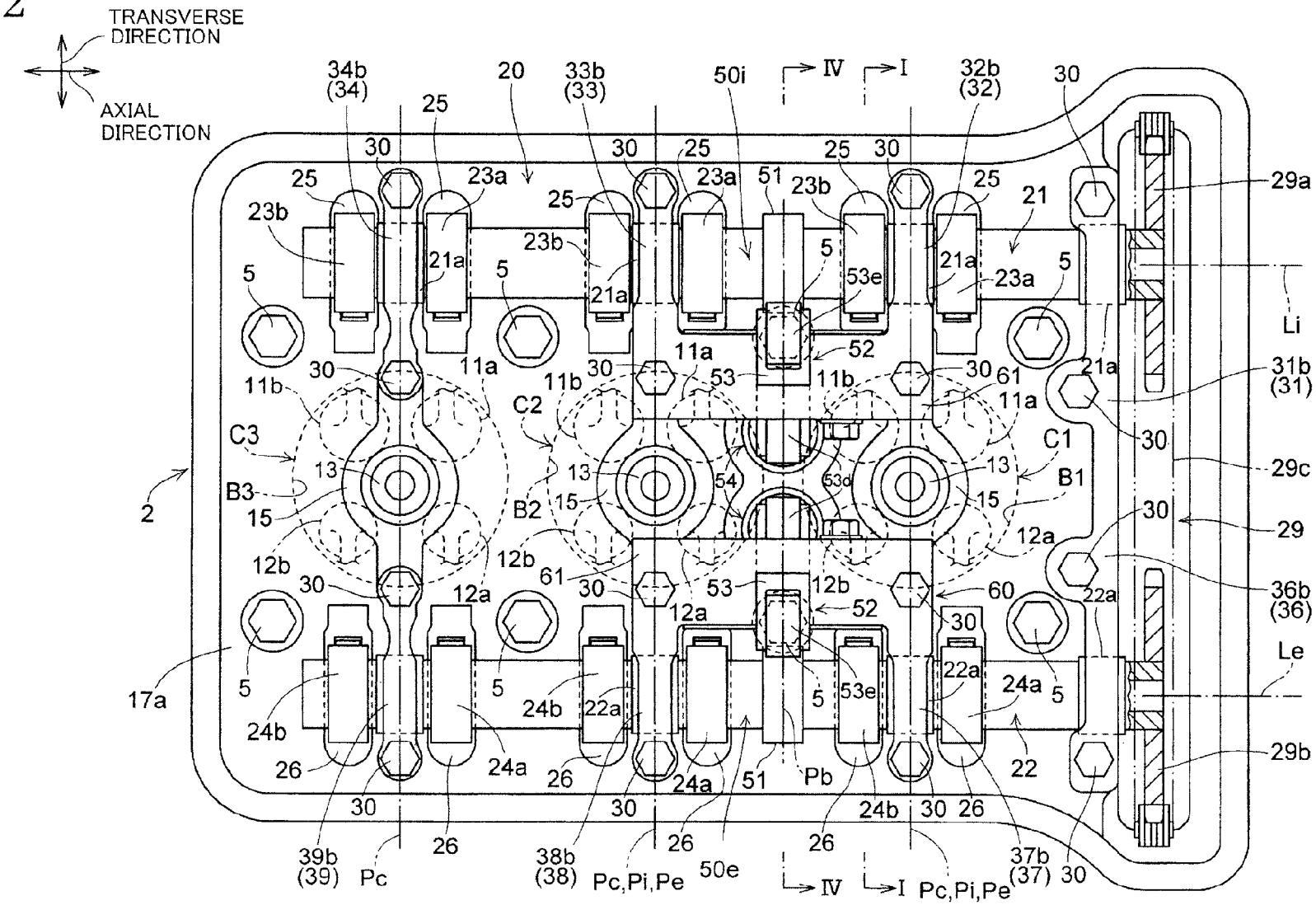
FIG. 2 is a plan view of the internal combustion engine shown in FIG. 1, in which a head cover is removed.

Referring to FIGS. 1 and 2, an internal combustion engine E provided with the valve train 20 of the present invention is a multiple-cylinder four-cycle internal combustion engine. The internal combustion engine E has an engine body including a cylinder block 1 provided with, for example, three cylinders C1 to C3 arranged in a line along an axial direction parallel to the axes of camshafts 21 and 22, a cylinder head 2 joined to the upper end of the cylinder block 1 with a head gasket 4 held between the cylinder block 1 and the cylinder head 2, and a head cover 3 joined to the upper end of the cylinder head 2.

In the following description, a 'vertical direction' is a cylinder-axis direction parallel to the axes $L_c$ of the cylinders C1 to C3, an 'axial direction' is a direction parallel to the respective center axes $L_i$ and $L_e$ of the camshafts 21 and 22, and a 'transverse direction' is a direction perpendicular to the axial direction in a horizontal plane as viewed from above, i.e., in a top plan view.

Figure 4:
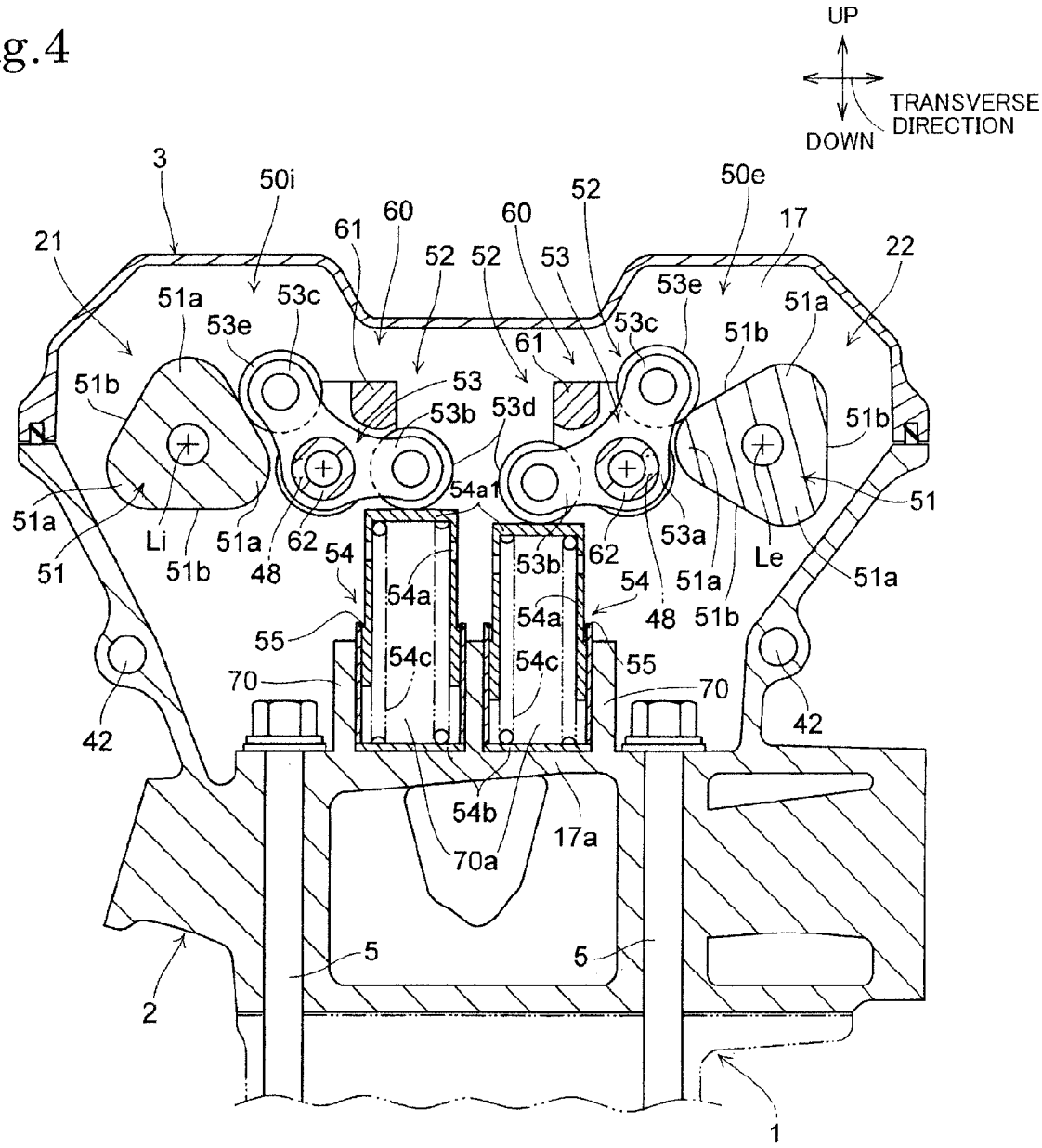
FIG. 4 is a sectional view taken on the line IV-IV in FIG. 2.

As shown in FIG. 4, the cylinder head 2 is fastened to the cylinder block 1 by tightening cylinder head bolts 5 inserted through holes formed in the cylinder head 2. The axes of the cylinder head bolts 5 and a fastening direction in which the cylinder head bolts 5 depress the cylinder head 2 are parallel to the vertical direction.

A crankshaft 6 (FIG. 1) included in the internal combustion engine E is supported for rotation on the cylinder block 1. Pistons 7 are axially slidably fitted in the cylinder bores B1 to B3 of the cylinders C1 to C3, respectively. The pistons 7 are driven for reciprocation by combustion gas produced by burning fuel in combustion chambers 8. The reciprocating motions of the pistons 7 are transmitted to the crankshaft 6 by connecting rods to drive the crankshaft 6 for rotation.

The cylinder head 2 has a part for defining a combustion chamber 8 together with the piston 7 for each of the cylinders C1 to C3, and is provided, for each of the cylinders C1 to C3, with an intake port 9 having a pair of inlets 9*a* opening into the combustion chamber 8, an exhaust port 10 having a pair of outlets 10*a* opening into the combustion chamber 8, a spark plug 13 facing substantially central part of the combustion chamber 8, a first intake vale 11*a* for opening and closing the inlet 9*a*, a second intake valve 11*b* for opening and closing the inlet 9*a*, a first exhaust valve 12*a* for opening and closing the outlet 10*a*, and a second exhaust valve 12*b* for opening and closing the outlet 10*a*.

The valve train 20 is disposed in a valve chamber 17 formed by joining the head cover 3 to the cylinder head 2. The valve train 20 drives the intake valves 11*a* and 11*b* and the exhaust valves 12*a* and 12*b*, namely, engine valves, for opening and closing operations. The valve train 20 includes the intake camshaft 21, namely, a camshaft, provided with first intake cams 23*a* and second intake cams 23*b* and rotatably supported by a camshaft holder mounted on the cylinder head 2, namely, a support member, the exhaust camshaft 22, namely, a second camshaft, provided with first exhaust cams 24*a* and second exhaust cams 24*b* and rotatably supported by a camshaft holder, intake rocker arms 25 driven by the intake cams 23*a* and 23*b* to open and close the intake valves 11*a* and 11*b*, exhaust rocker arms 26 driven by the exhaust cams 24*a* and 24*b* to open and close the exhaust valves 12*a* and 12*b*, pivots 27, namely, support members on which the intake rocker arms 25 and the exhaust rocker arms 26 turn, valve springs 28 constantly pushing the intake valves 11*a* and 11*b* and the exhaust valves 12*a* and 12*b* in a closing direction, and torque reducing mechanisms 50*i* and 50*e* (FIG. 2) for applying counter torques to the camshafts 21 and 22, respectively, to suppress torque fluctuation. Proper magnitudes of the counter torques are determined for the intake camshaft 21 and the exhaust camshaft 22, respectively.

The intake rocker arms 25 are driven by the intake cams 23*a* and 23*b* and the exhaust rocker arms 26 are driven by the exhaust cams 24*a* and 24*b* for a rocking motion on the pivots 27 held on the cylinder head 2, respectively.

In FIG. 2, the respective shapes of the intake cams 23*a* and 23*b*, the exhaust cams 24*a* and 24*b*, and counteraction cams 51, which will be described later, are shown simplified for convenience. Actually, the intake cams 23*a* and 23*b* and the exhaust cams 24*a* and 24*b* are at angular positions corresponding to order of ignition of the internal combustion engine E, respectively. The respective angular positions of the counteraction cams 51 are determined so as to suppress the torque fluctuation of the camshafts 21 and 22.

The camshafts 21 and 22 are parallel to the center axis of the crankshaft 6 and have parallel center axes $L_i$ and $L_e$, respectively. A torque produced by the crankshaft 6, namely, a drive torque, is transmitted to the camshafts 21 and 22 by a valve train transmission 29 to rotate the camshafts 21 and 22 in a rotating direction R. The valve train transmission 29 includes a drive sprocket, not shown, mounted on the crankshaft 6, camshaft sprockets 29*a* and 29*b*, namely, driven sprockets, mounted on the camshafts 21 and 22, respectively, and an endless chain 29*c* wound round the drive sprocket and the camshaft sprockets 29*a* and 29*b*.

The intake cams 23*a* and 23*b* that rotate together with the intake camshaft 21 open and close the intake valves 11*a* and 11*b* through the intake rocker arms 25. The exhaust cams 24*a* and 24*b* that rotate together with the exhaust camshaft 22 open and close the exhaust valves 12*a* and 12*b* through the exhaust rocker arms 26.

Figure 5:
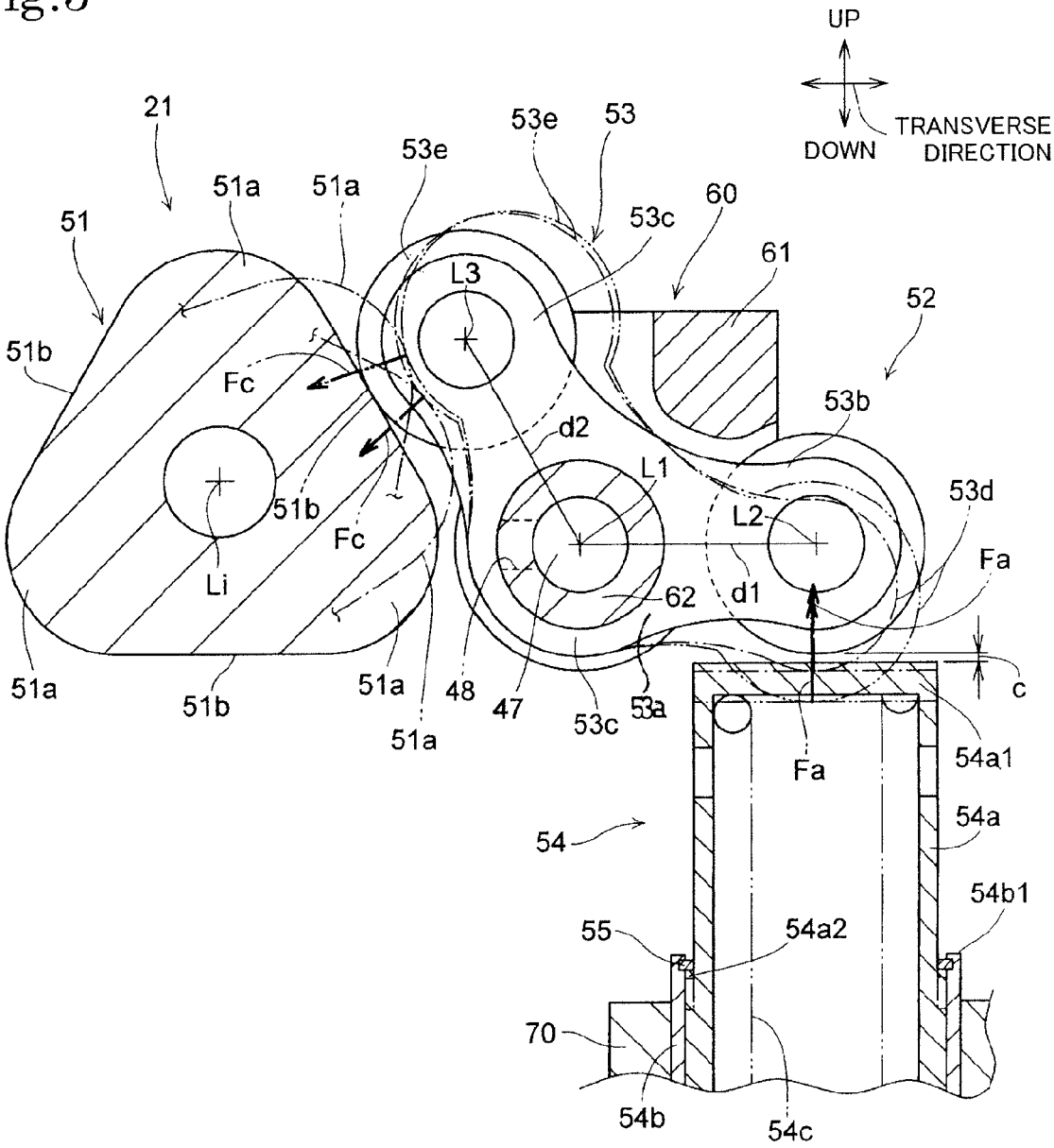
FIG. 5 is an enlarged view of an important part the internal combustion engine shown in FIG. 4.

The intake camshaft 21 is provided with the pairs of intake cams 23*a* and 23*b* for the cylinders C1 to C3, four journals 21*a* supported in the camshaft holder, and the counteraction cam 51, namely, the rotating member, to which the torque reducing mechanism 50*i* applies a counterforce as shown in FIG. 5. The exhaust camshaft 22 is provided with the pairs of exhaust cams 24*a* and 24*b* for the cylinders C1 to C3, four journals 22*a* supported in the camshaft holder, and the counteraction cam 51, namely, the rotating member, to which the torque reducing mechanism 50*e* applies a counterforce. The center axes of the counteraction cams 51 are aligned with the center axes $L_i$ and $L_e$, respectively.

Each of the journals 21*a* of the intake camshaft 21 excluding the end journal 21*a* adjacent to the valve train transmission 29 is disposed between the first intake cam 23*a* and the second intake cam 23*b* for each of the cylinders C1 to C3. Each of the journals 22*a* of the exhaust camshaft 22 excluding the end journal 22*a* adjacent to the valve train transmission 29 is disposed between the first exhaust cam 24*a* and the second exhaust cam 24*b* for each of the cylinders C1 to C3. Thus, the journals 21*a* and 22*a*, intake camshaft supports 32 to 34 and exhaust camshaft supports 37 to 39 extend perpendicular to cylinder planes $P_c$ (FIG. 2) containing the center axes of the cylinders C1 to C3 and perpendicular to the axial directions of the camshafts, respectively.

The counteraction cam 51 mounted on the intake camshaft 21 is disposed between the axially adjacent pair of intake cams 23*b* and 23*a* respectively for the axially adjacent cylinders C1 and C2. The counteraction cam 51 mounted on the exhaust camshaft 22 is disposed between the axially adjacent exhaust cams 24*b* and 24*a* forming a pair, respectively, for the axially adjacent cylinders C1 and C2.

As shown in FIG. 2, the camshaft holder placed in the valve chamber 17 includes, for example, four intake camshaft supports 31 to 34 axially arranged at intervals and for example, four exhaust camshaft supports 36 to 39 axially arranged at intervals. The intake camshaft supports 31 to 34 supporting the journals 21*a* of the intake camshaft 21 include lower bearing parts (33*a*, 33*a* seen in FIGS. 1 and 3) formed integrally with the cylinder head 2 and upper bearing parts 31*b* to 34*b* fastened to the lower bearing parts with bolts 30, respectively. The exhaust camshaft supports 36 to 39 supporting the journals 22*a* of the exhaust camshaft 22 includes lower bearing parts (37*a* seen in FIG. 1) and upper bearing parts 36*b* to 39*b* fastened to the lower bearing parts with bolts 30. The respective lower bearing parts of the end camshaft supports 31 and 36 adjacent to the valve train transmission 29 with respect to the axial direction are united and the respective upper bearing parts 31*b* and 36*b* of the same are also united. Each of the intake camshaft supports 32 to 34 for each of the cylinders C1 to C3 is disposed between the intake cams 23*a* and 23*b* forming a pair. Each of the exhaust camshaft supports 37 to 39 for each of the cylinders C1 to C3 are disposed between the exhaust cams 24*a* and 24*b* forming a pair.

Cylindrical walls 15 are formed integrally with the cylinder head 2 and the head cover 3. Each of the cylindrical walls 15 of the cylinder head 2 and the cylindrical wall 15 of the head cover 3 corresponding to the former cylindrical wall 15 define a space for receiving the spark plug 13 and an ignition coil 14 connected to the spark plugs. The respective lower bearing parts of the intake camshaft supports 32 to 34 and the exhaust camshaft supports 37 to 39 are formed integrally with the cylindrical walls 15, respectively. Thus, the camshaft holder has a lower camshaft holder including the lower bearing parts, and an upper camshaft holder including the upper bearing parts.

Figure 3:
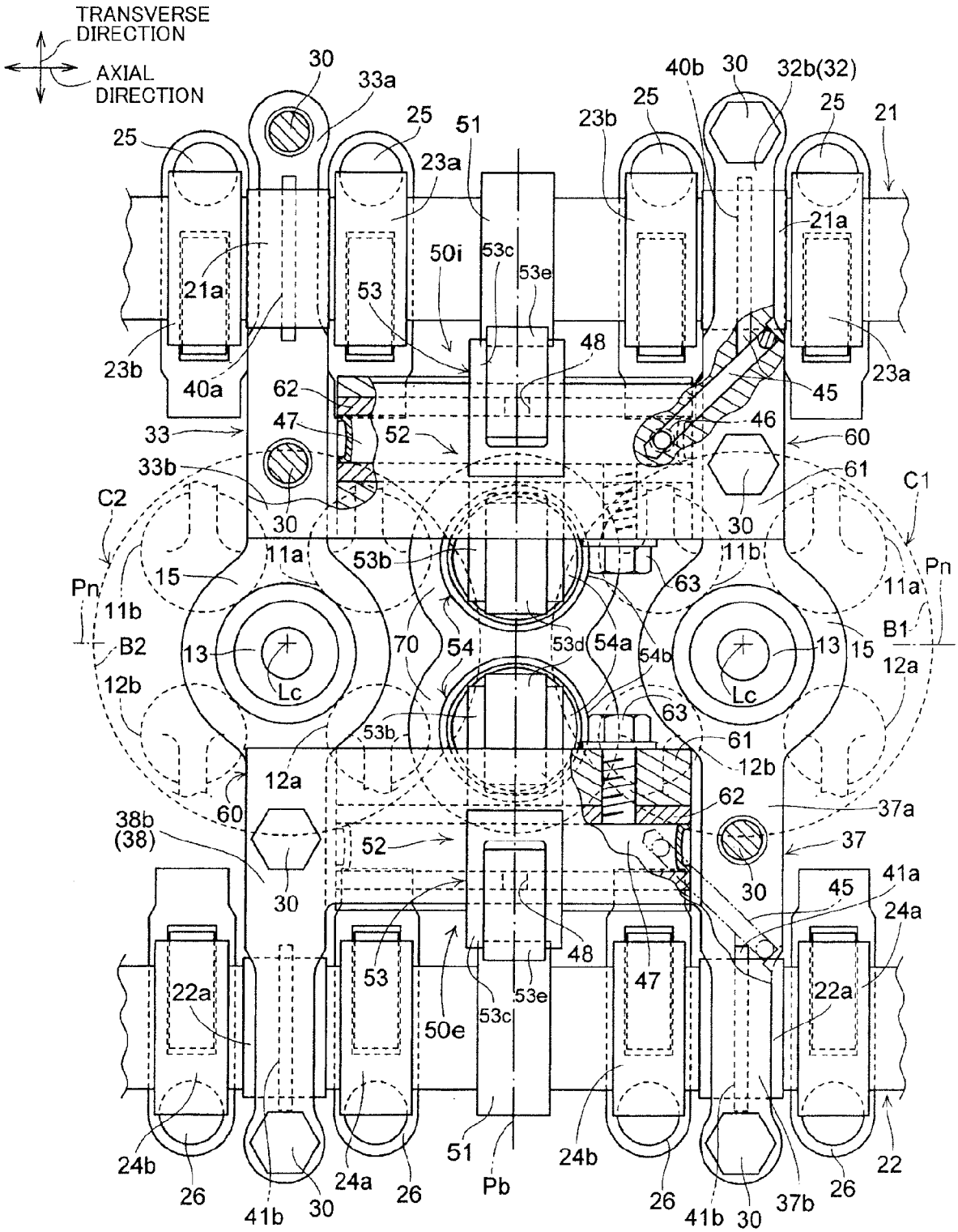
FIG. 3 is an enlarged plan view of an important part of the internal combustion engine shown in FIG. 2.

Referring to FIG. 3, oil grooves 40*a* and 40*b* are formed in the bearing surfaces for the journals 21*a*, of the lower bearing parts and the upper bearing parts 31*b* to 34*b*, respectively, and oil grooves 41*a* and 41*b* are formed in the bearing surfaces for the journals 22*a*, of the upper bearing parts 36*b* to 39*b*, respectively. Oil grooves 40*a* and 40*b* of the intake camshaft supports 32 and 33, and oil grooves 41*a* and 41*b* of the exhaust camshaft supports 37 and 38 are shown in FIGS. 1 and 3. Lubricant oil discharged from an oil pump included in the internal combustion engine E is delivered through oil passages, not shown, formed in the cylinder block 1, oil passages 42 (FIG. 4) formed in the cylinder head 2, and oil passages 43 formed in the lower bearing parts to the oil grooves 40*a*, 40*b*, 41*a* and 41*b*. The oil passages 43 formed in the lower bearing parts 31*a* and 37*a* are shown in FIG. 1. The oil flows through the oil passages 43 through the oil grooves 40*a* and 41*a* into the oil grooves 40*b* formed in the upper bearing parts 31*b* to 34*b* and through the oil grooves 41*a* formed in the upper bearing parts 36*b* to 39*b*. Part of the oil flowing into the oil passages 42 is supplied to hydraulic lash adjusters of the pivots 27.

The intake camshaft torque reducing mechanism 50*i*, namely, a first torque reducing mechanism, applies a counter torque to the intake camshaft 21 to suppress the fluctuation of the torque applied to the intake camshaft 21 resulting from reaction forces of the open intake valves 11*a* and 11*b*. Similarly, the exhaust camshaft torque reducing mechanism 50*e*, namely, a second torque reducing mechanism, applies a counter torque to the exhaust camshaft 22 to suppress the fluctuation of the torque applied to the exhaust camshaft 22 resulting from reaction forces of the open exhaust valves 12*a* and 12*b*. The reaction forces are produced by the resilience of the valve springs 28.

Since the torque reducing mechanisms 50*i* and 50*e* are similar in basic construction, the intake camshaft torque reducing mechanism 50*i* will be mainly described and characters indicating the members of the exhaust camshaft torque reducing mechanism 50*e* relevant to the description of the exhaust camshaft torque reducing mechanism 50*e* will be shown in parentheses as the need arises.

Referring to FIGS. 4 and 5, the torque reducing mechanism 50*i* (50*e*) includes the counteraction cam 51, namely, a rotating member, formed integrally with the camshaft 21 (22) for rotation together with the camshaft 21 (22), a counterforce applying mechanism 52 for applying a counterforce $F_c$ (FIG. 5) to the counteraction cam 51 to produce a counter torque to be applied to the camshaft 21 (22), and a snap ring 55, namely, a stopping means, for preventing the counterforce applying mechanism 52 from applying the counterforce $F_c$ to the counteraction cam 51.

The counterforce applying mechanism 52 includes a lever 53 supported for rocking on a connecting member 60, which will be described later. A pressing device 54 fixedly held on the cylinder head 2 produces a force $F_a$ (FIG. 5) to be applied to the lever 53 to press the lever 53 against the counteraction cam 51. The counterforce applying mechanism 52 is supported for rocking on the connecting member 60.

The torque reducing mechanism 50*i* applies the counterforce $F_c$ on the counteraction cam 51 of the intake camshaft 21 to apply a counter torque for suppressing the fluctuation of the driving torque of the intake camshaft 21 caused by the reaction forces of the intake valves 11*a* and 11*b* produced by the valve springs 28. Similarly, the torque reducing mechanism 50*e* applies the counterforce $F_c$ on the counteraction cam 51 of the exhaust camshaft 22 to apply a counter torque for suppressing the fluctuation of the driving torque of the exhaust camshaft 22 caused by the reaction forces of the exhaust valves 12*a* and 12*b* produced by the valve springs 28.

The counteraction cam 51 has three cam lobes 51*a* respectively corresponding to the three cylinders C1 to C3, and three heels 51*b* each extending between the cam lobes 51*a* that are adjacent with respect to the rotating direction R. Thus, a desired torque fluctuation suppressing effect can be ensured, and the numbers of the counteraction cams 51 and the counterforce applying mechanisms 52 can be reduced by reducing the number of the cam lobes 51*a* below the total number of the intake cams 23*a* and 23*b* and the exhaust cams 24*a* and 24*b*.

A roller 53*e* supported on the lever 53 applies the counterforce $F_c$ to the cam lobes 51*a*. The roller 53*e* does not come into engagement with the heels 51*b* when the lever 53 is pressed by the pressing device 54. Therefore, the counterforce $F_c$ produced by the force $F_a$ (FIG. 5) does not work on the heels 51*b*. The angular positions of the heels 51*b* correspond to the angular positions A3 of the camshaft 21, namely, cam angles A3 (FIG. 6), at which the absolute value of torque variation in the camshaft 21 (22) is below a predetermined value. The same condition applies to the heels 51*b* of the counteraction cam 51 associated with the exhaust camshaft 22. The predetermined value is one of values including zero determined by taking an angular position at which a torque variation is small enough not to need torque fluctuation suppression. For example, the predetermined value is in the range of 0% to 10% of a maximum torque variation.

The lever 53 is supported for rocking about an axis L1 on the connecting member 60 connecting the upper bearing parts 32*b* and 33*b* (37*b* and 38*b*) of the two axially two adjacent camshaft supports 32 and 33 (37 and 38). Thus the lever 53 is supported for rocking by the camshaft supports 32 and 33 (37 and 38) on the cylinder head 2. As shown in FIG. 3, the connecting member 60 is nearer to the center plane $P_n$ of the internal combustion engine E than the camshaft 21 (22) with respect to the transverse direction. The connecting member 60 is between the camshaft 21 (22) and the cylindrical wall 15 with respect to the transverse direction. The center plane $P_n$ is parallel to the axial direction and contains the axes $L_c$ of the cylinders C1 to C3.

The connecting member 60 has a base part 61 formed integrally with the upper bearing parts 32*b* and 33*b* (37*b* and 38*b*) and a support shaft 62 supported on the base part 61. The base part 61 is formed integrally with the upper bearing parts 32*b* and 33*b* (37*b* and 38*b*) and is fixed. The support shaft 62 is attached to the base part 61 by being fitted in holes formed in the base part 61. The support shaft 62 is fixed to the base part 61 with a screw 63 and is not turnable and not axially movable relative to the base part 61. In a modification, the base part 61 may be a member separate from the upper bearing parts 32*b* and 33*b* (37*b* and 38*b*) and united to the upper bearing parts 32*b* and 33*b* (37*b* and 38*b*).

The support shaft 62 is provided with oil passages 46, 47 and 48. As shown in FIG. 3, the oil flows from the oil groove 40*b* (41*b*) of the upper bearing part 32*b* (37*b*) through an oil passage 45 formed in the upper bearing part 32*b* (37*b*) and the base part 61 into the oil passages 46, 47 and 48. The oil flows from the oil groove 40*b* (41*b*) through an oil passage 46 including the oil passage 45 and oil holes formed in the support shaft 62 into an oil passage 47 formed in a hollow part of the support shaft 62. The oil is delivered from the oil passage 47 through an oil passage 48 (FIG. 5) including oil holes formed in the support shaft 62 to sliding parts of the support shaft 62 and a fulcrum part 53*a* of the lever 53 (FIGS. 4 and 5).

Since the lever 53 is supported on the connecting member 60 connecting the camshaft supports 32 and 33 (37 and 38), the oil can be supplied from the oil passage 42 of the cylinder head 2 through the oil passages 45 to 48 formed in the upper bearing part 32*b* (37*b*) and the connecting member 60 to the sliding parts of the support shaft 62 and the fulcrum part 53*a* of the lever 53 by using only the upper bearing part 32*b* (37*b*) and the connecting member 60 provided with the oil passage 40*b* (41*b*) for carrying the oil to lubricate the journals 21*a* (22*a*) of the camshaft 21 (22) and the camshaft support 32 (37). Therefore, any additional oil passages do not need to be formed in the cylinder head 2 for lubricating the torque reducing mechanism 50*i* (50*e*). Thus, the oil can be supplied to parts requiring lubrication of the connecting member 60 and the lever 53 through the oil passages of simple construction.

Referring in particular to FIG. 5, the lever 53 has a fulcrum part 53*a* through which the support shaft 62 having a center axis aligned with a pivot axis L1 about which the lever 53 rocks extends to support the lever 53 for turning thereon, an input arm 53*b* extending from the fulcrum part 53*a* in one direction and an output arm 53*c* extending from the fulcrum part 53*a* in another direction. The lever 53 having the fulcrum part 53*a*, the input arm 53*b* and the output arm 53*c* rocks about the axis L1. When the pressing device 54 applies a force $F_a$ on the input arm 53*b*, the output arm 53*c* turns about the axis L1 to apply the counterforce $F_c$ to the counteraction cam 51.

More concretely, the input arm 53*b* is provided with a roller 53*d*, namely, an input member, and the output arm 53*c* is provided with a roller 53*e*, namely, an output member. A pressing member 54*a*, which will be described later, included in the pressing device 54 comes into contact with the roller 53*d* and applies the force $F_a$ to the roller 53*d*. The roller 53*e* comes into contact with the counteraction cam 51 to apply the counterforce $F_c$ to the counteraction cam 51. The roller 53*e* is pressed against the cam lobe 51*a* of the counteraction cam 51 to apply to the counteraction cam 51 the counterforce $F_c$ proportional to the force $F_a$ applied to the roller 53*d* by the pressing member 54*a*.

Since the roller 53*e* of the lever 53 is in rolling contact with the counteraction cam 51, loss in the driving torque is small, which contributes to reduction of fuel consumption.

The magnitude of the counterforce $F_c$ dependent on the magnitude of the force $F_a$ can be easily changed by changing the leverage of the lever 53, namely, the ratio of the effective length of the output arm 53*c* to that of the input arm 53*b*.

In this embodiment, the effective length of the input arm 53*b* is equal to the distance d1 between the axis L1 and the input reference axis of the input arm 53*b*, namely, the center axis L2 of the roller 53*d*, and the effective length of the output arm is equal to the distance d2 between the axis L1 and the output reference axis of the output arm 53*c*, namely, the center axis L3 of the roller 53*c*.

The shape of the counteraction cam 51 and the counterforce $F_c$ cancels out torque variation and suppresses torque fluctuation. Most desirably, the shape of the counteraction cam 51 is designed and the counterforce $F_c$ is determined so that a counter torque (FIG. 6) capable of substantially completely canceling out the torque variation can be applied to the camshaft.

The pressing device 54, which applies the force $F_a$ to the input arm 53 to press the output arm 53*c* against the counteraction cam 51, includes a cylindrical pressing member 54*a* having an top wall 54*a*1 to be pressed against the roller 53*d*, a bottomed, cylindrical guide member 54*b* held by a holding protrusion 70 formed in the cylinder head 2 to guide the pressing member 54*a* for vertical movement, and a compression coil spring 54*c*, namely, an elastic member, extended between the pressing member 54*a* and the guide member 54*b*.

When the lever 53 is turned about the axis L1 by the counteraction cam 51 so as to move the pressing member 54*a* vertically down to compress the compression coil spring 54*c*, the resilience of the compression coil spring 54*c* makes the pressing member 54*a* apply the upward force $F_a$ on the roller 53*d*. At the same time, the resilience of the compression coil spring 54*c* depresses the cylinder head 2 toward the cylinder block 1 provided with the cylinders C1 to C3.

The holding protrusion 70 is a bottomed, cylindrical protrusion formed integrally with and protruding upward from the bottom wall 17*a* of the valve chamber 17. The guide member 54*b* is fitted in the bore 70*a* of the holding protrusion 70 and is fixedly held by the holding protrusion 70. Part of the pressing member 54*a* is received in the guide member 54*b* fixedly fitted in bore 70*a* of the holding protrusion 70. The bottom wall 17*a* defining the bottom of the holding protrusion 70 is a part of an upper deck which is a part of the cylinder head 2.

Referring to FIGS. 4 and 5, a snap ring 55 is fitted in an annular groove formed in an upper end part 54*b*1 of the guide member 54*b* to limit the upward movement of the pressing member 54*a*. A ring 54*a*2 formed on the outside surface of the pressing member 54*a* to form a stepped part comes into contact with the snap ring 55 to stop the pressing member 54*a* at an upper end position as shown in FIG. 5. When the pressing member 54*a* is at the upper end position shown in FIG. 5, the counteraction cam 51 mounted on the intake camshaft 21 is at an angular position shown in FIG. 5.

When the pressing member 54*a* is at the upper end position, the camshaft 21 (22) is at an angular position A3 where at least the heel 51*b* of the counteraction cam 51 can be in contact with the roller 53*e* of the lever 53 pressed by the pressing device 54.

When the pressing member 54*a* is at the upper end position, the force $F_a$ proportional to the resilience of the compression coil spring 54*c* does not act on the roller 53*d*. Consequently, the roller 53*e* does not apply the counterforce $F_c$ proportional to the force $F_a$ on the counteraction cam 51 and hence the counter torque is not produced. Therefore, a very small gap c may be formed between the top wall 54*a*1 of the pressing member 54*a* and the roller 53*d* as shown in FIG. 5. In FIG. 5, the gap c is exaggerated in FIG. 5 to facilitate understanding.

When the camshaft 21 (22) rotates, the cam lobe 51*a* of the counteraction cam 51 comes into contact with the roller 53*e* and, consequently, the pressing member 54*a* is moved down. Then, the compression coil spring 54*c* is strained by a compression length corresponding to the distance of downward movement of the pressing member 54*a* and produces resilience proportional to the strain of the compression coil spring 54*c*. The force produced by the resilience of the strained compression coil spring 54*c* acts vertically upward and the force $F_a$ proportional to the resilience acts upward. The force $F_a$ is applied to the roller 53*d* of the lever 53 by the top wall 54*a*1 of the pressing member 54*a*. The lever 53 changes the direction of action of the upward force $F_a$ to apply the counterforce $F_c$ proportional to the force $F_a$ to the counteraction cam 51 by the roller 53*e*.

Referring to FIGS. 1 to 4, the counteraction cam 51, the lever 53, the pressing member 54*a*, the guide member 54*b*, the compression coil spring 54*c* and the holding protrusion 70 are disposed between the respective cylinder bores B1 and B2 of the axially adjacent cylinders C1 and C2. In other words, the counteraction cam 51, the lever 53, the pressing member 54*a*, the guide member 54*b*, the compression coil spring 54*c* and the holding protrusion 70 are contained in an interbore plane $P_b$ which extends between the respective cylinder bores B1 and B2 of the axially adjacent cylinders C1 and C2 and which is perpendicular to the axial direction. The interbore plane $P_b$ is shown in FIGS. 2 and 3.

The lever 53, the connecting member 60, the pressing member 54*a*, the guide member 54*b*, the compression coil spring 54*c* and the holding protrusion 70 are disposed between the camshaft supports 32 and 33 (37 and 38) connected by the connecting member 60 with respect to the axial direction. More concretely, the counteraction cam 51, the lever 53, the pressing member 54*a*, the guide member 54*b* and the compression coil spring 54*c* of the intake camshaft torque reducing mechanism 50*i*, and the holding protrusion 70 holding the pressing member 54*a* of the intake camshaft torque reducing mechanism 50*i* are disposed between the intake camshaft supports 32 and 33 connected by the connecting member 60 or between support planes $P_i$ respectively crossing the intake camshaft supports 32 and 33, and the counteraction cam 51. The lever 53, the pressing member 54*a*, the guide member 54*b* and the compression coil spring 54*c* of the exhaust camshaft torque reducing mechanism 50*e*, and the holding protrusion 70 holding the pressing member 54*a* of the exhaust camshaft torque reducing mechanism 50*e* are disposed between the exhaust camshaft supports 37 and 38 connected by the connecting member 60 or between support planes $P_e$ respectively crossing the exhaust camshaft supports 37 and 38.

The support planes $P_i$ are perpendicular to the axial direction and extend across the intake camshaft supports 31 to 34, respectively. The support planes $P_e$ are perpendicular to the axial direction and extend across the exhaust camshaft supports 36 to 39, respectively. The support planes $P_i$ extending across the intake camshaft supports 32 and 33, and the support planes $P_e$ extending across the exhaust camshaft supports 37 and 38 are shown by way of example in FIG. 2.

In this embodiment, the intake camshaft support 32 and the exhaust camshaft support 37 are contained in the same support plane, and the intake camshaft support 33 and the exhaust camshaft support 38 are contained in the same support plane. The counteraction cam 51, the lever 53, the pressing member 54*a*, the guide member 54*b* and the compression coil spring 54*c* of the intake camshaft torque reducing mechanism 50*i* and the holding protrusion 70 holding the pressing member 54*a* of the intake camshaft torque reducing mechanism 50*i*; and the counteraction cam 51, the lever 53, the pressing member 54*a*, the guide member 54*b* and the compression coil spring 54*c* of the exhaust camshaft torque reducing mechanism 50*e* and the holding protrusion 70 holding the pressing member 54*a* of the exhaust camshaft torque reducing mechanism 50*i* are substantially symmetrical with respect to the center plane $P_n$ of the internal combustion engine E.

The pressing members 54*a*, the guide members 54*b*, the compression coil springs 54*c* and the holding protrusion 70 are disposed between the intake camshaft 21 and the exhaust camshaft 22 with respect to the transverse direction, namely, the second direction, perpendicular to the vertical direction, namely, the first direction, as viewed in the axial direction, and between a pair of cylinder head bolts 5 disposed opposite to each other with respect to the transverse direction. The intake camshaft 21 and the exhaust camshaft 22 are opposite to each other with respect to the transverse direction.

Referring to FIGS. 1, 4 and 5, the base part 61 and the support shaft 62 of the connecting member 60, the pressing member 54*a*, the compression coil spring 54*c*, the guide member 54*b* and the holding protrusion 70 are below the level of the highest position that the counteraction cam 51 can reach and the level of the highest position that the lever 53 can reach. The axis L1 about which the lever 53 rocks is at a height below the level of the respective center axes $L_i$ and $L_e$ of the camshafts 21 and 22. The pressing member 54*a*, the compression coil spring 54*c*, the guide member 54*b* and the holding protrusion 70 are disposed at positions close to the cylinders C1 to C3 with respect to the vertical direction and below the level of the center axes $L_i$ and $L_e$. The point of action of the counterforce $F_c$ on the counteraction cam 51 is at a position above the level of the center axes $L_i$ and $L_e$. Most part of the lever 53 with respect to the vertical direction is below the level of the highest position that the counteraction cam 51 can reach. At least some parts of the lever 53 and the counteraction cam 51 are at the same position with respect to the vertical direction; that is, the lever 53 and the counteraction cam 51 overlap each other at least partly with respect to the vertical direction. Therefore, the lever 53 does not protrude greatly from the counteraction cam 51 when the arm 53 rocks. The lever 53 may be disposed such that the lever 53 is entirely below the level of the highest position that the counteraction cam 51 can reach with respect to the vertical direction.

Thus, the connecting member 60, the pressing member 54*a*, the compression coil spring 54*c*, the guide member 54*b* and the holding protrusion 70 are below the level of the counteraction cam 51 and the lever 53 can be disposed at a position lower than the counteraction cam 51 in the valve chamber 17. Therefore, increase in the vertical dimension of the internal combustion engine E by the torque reducing mechanisms 50*i* and 50*e* can be avoided.

The point of action of the counterforce $F_c$ of the roller 53*e* on the counteraction cam 51 is at a level higher than that of the center axis $L_i$ of the camshaft 21 (the center axis $L_e$ of the camshaft 22).

The torque reducing operation of the torque reducing mechanism 50*i* associated with the intake camshaft 21 will be described with reference to FIGS. 1, 5 and 6. The torque fluctuation of the exhaust camshaft 22 is suppressed by the torque reducing mechanism 50*e* similarly to that of the intake camshaft 21.

When the intake camshaft 21 starts turning from an angular position shown in FIGS. 1 and 5 and is being rotated by the valve train transmission 29 in an angular range A1, in which the intake valves 11*a* and 11*b* for one of the cylinders C1 to C3 are lifted by the intake cams 23*a* and 23*b* toward a fully open position where the intake valves 11*a* and 11*b* are at a maximum lift, while the internal combustion engine E is in operation, the intake valves 11*a* and 11*b* apply reaction forces resulting from the resilience of the valve springs 28 through the rocker arms 25 to the intake cams 23*a* and 23*b*. Consequently, a counter torque reverse to the driving torque rotating the intake camshaft 21, namely, torque acting in a counterclockwise direction in FIGS. 1 and 5, is applied to the intake camshaft 21 to cause the driving torque to fluctuate.

On the other hand, when the camshafts 21 (22) is in the angular range A1 excluding the angular position A3, the cam lobe 51*a* of the counteraction cam 51 in contact with the roller 53*e* turns the lever 53 clockwise as viewed in FIG. 5 on the support shaft 62. Then, the lever 53 presses the pressing member 54*a* downward against the resilience of the compression coil spring 54*c*. In FIG. 5, the angular position of the counteraction cam 51 when the angular position of the intake camshaft 21 is in the angular range A1 is indicated by a chain line by way of example.

The pressing member 54*a* applies the force $F_a$ produced by the resilience of the compression coil spring 54*c* to the roller 53*d* of the lever 53 and the roller 53*e* applies the counterforce $F_c$ acting in a direction different from the direction of action of the force $F_a$ to the cam lobe 51*a* of the counteraction cam 51 to apply the counterclockwise counter torque produced by the counterforce $F_c$ to the intake camshaft 21. As shown in FIG. 6, the counter torque cancels out reaction torque substantially completely. Thus, the counter torque reduces the reaction torque to suppress the torque variation of the intake camshaft 21.

Figure 6:
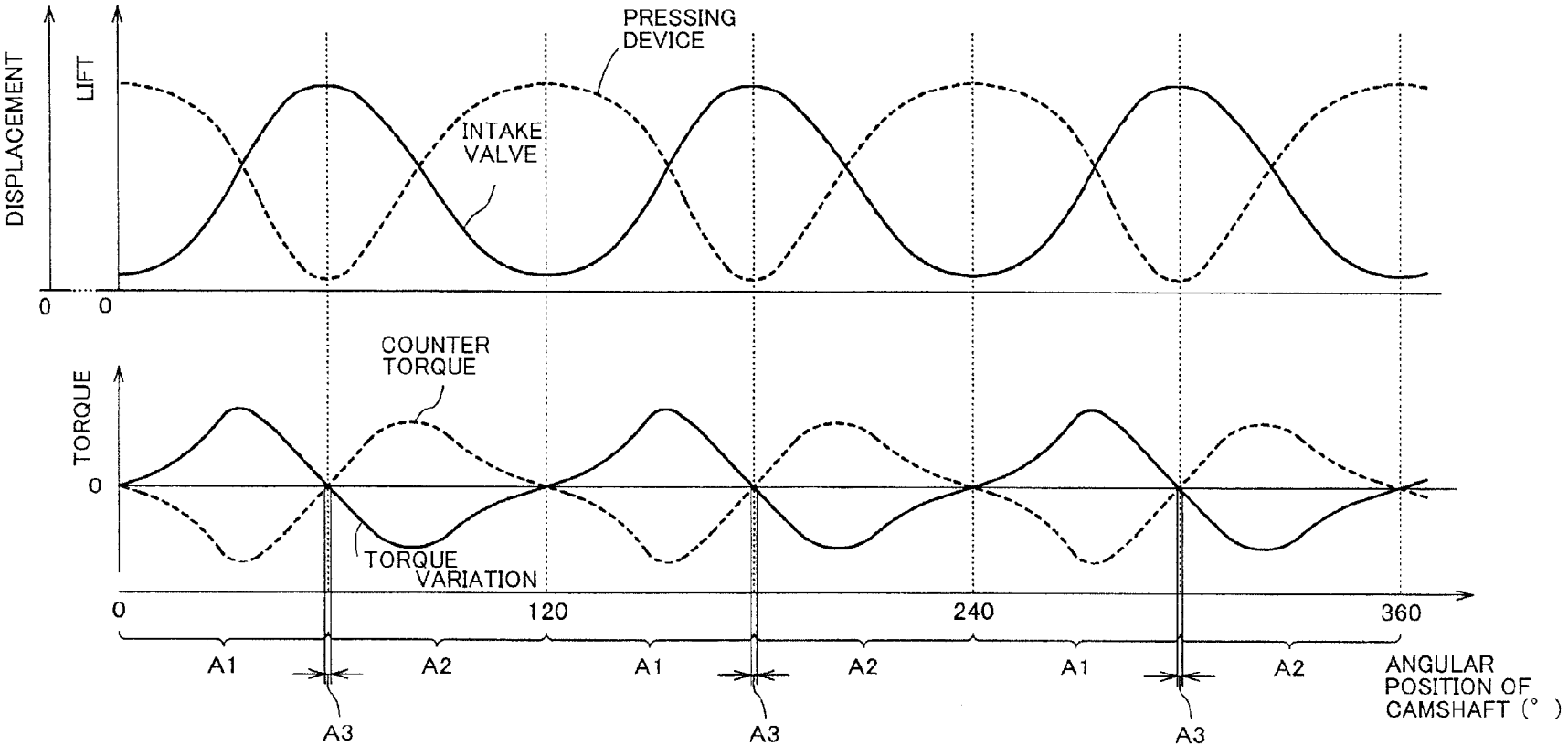
FIG. 6 is a graph showing variations of the lift of an intake valve and the displacement of a counterforce applying mechanism caused by a counter torque application cam with the angular position of a camshaft, namely, a cam angle, and a graph showing variations of counter torque (or torque fluctuation) applied to a camshaft and a counter torque with the angular position of the camshaft.

In FIG. 6, the reaction torque and the counter torque acting in the clockwise direction, as viewed in FIGS. 1 and 5, are positive and those acting in the counterclockwise direction, as viewed in FIGS. 1 and 5, are negative.

When the intake camshaft 21 is in an angular range A2, in which the intake valves 11*a* and 11*b* are being moved from the fully open position toward the fully closed position by the intake cams 23*a* and 23*b*, the intake valves 11*a* and 11*b* apply reaction forces respectively proportional to the resilience of the valve springs 28 through the rocker arms 25 to the intake cams 23*a* and 23*b*. Consequently, a reaction force works on the intake camshaft 21 (the exhaust camshaft 22) in the same direction as the drive torque (the counterclockwise direction as viewed in FIGS. 1 and 5) causing the drive torque to fluctuate.

While the intake cam position is in the angular range A2 excluding the angular position A3, the cam lobe 51*a* of the counteraction cam 51 in contact with the roller 53*e* turns the lever 53 on the support shaft 62 in a counterclockwise direction as viewed in FIG. 5 and the pressing member 54*a* is moved upward by the resilience of the compression coil spring 54*c*. In FIG. 5, the angular position of the counteraction cam 51 when the angular position of the intake camshaft 21 is in the angular range A2 is indicated by a two-dot chain line by way of example.

Consequently, the pressing member 54*a* applies the force $F_a$ proportional to the resilience of the compression coil spring 54*c* on the roller 53*d*, and the roller 53*e* applies the counterforce $F_c$ proportional to the force $F_a$ to the cam lobe 51*a* of the counteraction cam 51 to apply a counter torque produced by the counterforce $F_c$ and acting in the clockwise direction, as viewed in FIG. 5, to the intake camshaft 21. As shown in FIG. 6, the counter torque cancels out the reaction torque substantially completely and suppresses the fluctuation of the drive torque substantially perfectly. Thus, the torque fluctuation of the intake camshaft 21 is suppressed.

Referring to FIGS. 1 and 5, the reaction forces, not shown, of the intake valves 11*a* and 11*b* acting on the intake cams 23*a* and 23*b*, respectively, have components of force acting in an upward direction, and the counterforce $F_c$ acting on the counteraction cam 51 has a component of force acting in a downward direction. The lever 53 is a transmission member that converts the upward force $F_a$ acting on the roller 53*d* into the counterforce $F_c$ proportional to the force $F_a$ and acting in a direction different from the direction of the force $F_a$ and applies the counterforce $F_c$ to the counteraction cam 51.

The reaction forces of the intake valves 11*a* and 11*b* and the counterforce $F_c$ respectively having components of force acting in opposite directions with respective to the vertical direction counterbalance each other. Therefore, the component of force acting in the vertical direction of the resultant of the reaction force acting on the intake camshaft 21 and the counterforce $F_c$ is reduced.

The operation and effect of the valve train 20 in the first embodiment will be described.

The torque reducing mechanism 50*i* (50*e*) included in the valve train 20 of the internal combustion engine E applies the counter torque to the camshaft 21 (22) to suppress the torque fluctuation of the camshaft 21 (22) caused by the reaction forces of the intake valves 11*a* and 11*b* (exhaust valves 12*a* and 12*b*). The torque reducing mechanism 50*i* (50*e*) includes the counteraction cam 51 that rotates together with the camshaft 21 (22), and the counterforce applying mechanism 52 for applying the counterforce $F_c$ to the counteraction cam 51 to apply the counter torque to the camshaft 21 (22). The counterforce applying mechanism 52 is supported on the connecting member 60 connecting the support parts 32 and 33 (37 and 38) rotatably supporting the camshaft 21 (22). Thus, the counterforce applying mechanism 52 is supported on the connecting member 60 provided by utilizing the two support parts 32 and 33 (37 and 38) rotatably supporting the camshaft 21 (22). Thus, the counterforce applying mechanism 52 can be installed without omitting any one of the support parts 31 to 34 (36 to 39). Therefore, the torque reducing mechanism 50*i* (50*e*) can suppress the fluctuation of the torque applied to the camshaft 21 (22), the camshaft supports 31 to 34 (36 to 39) can suppress the bending deformation of the camshaft 21 (22), and increase in the weight of the camshaft 21 (22) resulting from the use of the torque reducing mechanism 50*i* (50*e*) can be avoided. Since the rigidity of the connecting member 60 supporting the counterforce applying mechanism 52 is enhanced by the two adjacent camshaft supports 32 and 33 (37 and 38), the counterforce applying mechanism 52 can be supported by the connecting member 60 having a necessary rigidity and can avoid increasing the size of the cylinder head 2 of the internal combustion engine E effectively as compared with the counterforce applying mechanism supported by a support member not connected to any of the camshaft supports 31 to 34 (36 to 39). Since the two adjacent camshaft supports 32 and 33 (37 and 38) are connected by the base part 61 of the connecting member 60, rigidity necessary for supporting the support shaft 62 can be enhanced.

The lever 53 has the input arm 53*b* and the output arm 53*c* that rocks together with the input arm 53*b*, the pressing device 54 applies the force $F_a$ to the input arm 53*b* to press the output arm 53*c* against the counteraction cam 51, and the output arm 53*c* applies the counterforce $F_c$ proportional to the force $F_a$ to the counteraction cam 51. Since the lever 53 supported for rocking on the support shaft 62 has the input arm 53*b* and the output arm 53*c* united together to apply the counterforce $F_c$ proportional to the force $F_a$ to the counteraction cam 51, the magnitude of the counterforce $F_c$, which is to be applied by the output arm 53*c* to the counteraction cam 51 and which is proportional to the force $F_a$ applied to the input arm 53*b*, can be easily changed by changing the leverage of the lever 53. Consequently, a proper counter torque for suppressing torque fluctuation can be set by the simple mechanism and the torque fluctuation suppressing effect can be enhanced. The degree of freedom of disposing the counterforce applying mechanism 52 can be increased by changing the respective effective lengths of the input arm 53*b* and the output arm 53*c*.

The ratio of the counterforce $F_c$ to the force $F_a$ can be changed by changing the leverage of the lever 53. Therefore, the desired counterforce $F_c$ can be produced by changing the leverage of the lever 53 when it is difficult to use the force $F_a$ of a necessary magnitude due to a restriction on the shape of the cam lobe 51, such as a limit to the lift of the cam lobe 51, that may be placed on the counteraction cam 51 when the counteraction cam 51 has many cam lobes 51*a*.

The counterforce applying mechanism 52 is made up of the lever 53 supported for rocking, and the pressing device 54 that produces the force $F_a$ for pressing the lever 53 against the counteraction cam 51. The lever 53 applies the counterforce $F_c$ proportional to the force $F_a$ applied to the lever 53 and acting in a direction different from the direction of action of the force $F_a$ to the counteraction cam 51. Since the force $F_c$ can be converted into the counterforce $F_c$ acting in the direction different from the direction of action of the force $F_a$, the degree of freedom of disposing the counterforce applying mechanism 52 increases and increase in the size of the internal combustion engine E due to the incorporation of the torque reducing mechanism 50*i* (50*e*) can be suppressed.

The lever 53 and the pressing device 54 are disposed between the respective cylinder bores B1 and B2 of the axially adjacent cylinders C1 and C2 as viewed in a direction parallel to the axes of the cylinders C1 and C2. The pressing device 54 is disposed close to the cylinders C1 to C3 at a position below the level of the center axes $L_i$ and $L_e$ of the camshafts 21 and 22. Since the lever 53 and the pressing device 54 are disposed between the axially adjacent cylinder bores B1 and B2, the lever 53 and the pressing device 54 can be arranged in a space which is narrow in the transverse direction so as to avoid interference with the intake valves 11*a* and 12*a* and the exhaust valves 12*a* and 12*b*, and the cylinder head 2 can be formed in a small size. Moreover, since the pressing device 54 is disposed at the position below the level of the respective axes $L_i$ and $L_e$ of the intake camshaft 21 and the exhaust camshaft 22, the lever 53 and the pressing device 54 can be disposed in a narrow space adjacent to the cylinders C1 to C3 with respect to the vertical direction. Thus, the internal combustion engine E can be formed in small vertical size.

The pressing devices 54 are disposed between the pair of transversely opposite cylinder head bolts 5 and are held on the cylinder head 2. Since the pressing devices 54 press the cylinder head 2 in the fastening direction of the cylinder head bolts 5, the effect of sealing the joint of the cylinder head 2 and the cylinder block 1 joined together with the gasket 4 held therebetween can be improved.

The torque reducing mechanism 50*i* (50*e*) is provided with the snap ring 55, namely, a stopper, for preventing the pressing member 54*a* from applying the force $F_a$ to the lever 53 when torque variation is not greater than a predetermined value. Therefore, the lever 53, which is turned by the pressing member 54*a* to which the force $F_a$ produced by the compression coil spring 54*c* is applied and comes into contact with the counteraction cam 51 to apply the force $F_c$ to the counteraction cam 51, is restrained from coming into contact with the counteraction cam 51 to apply the counter torque to the counteraction cam 51 by the agency of the snap ring 55 when the variation of the torque applied to the camshaft 21 (22) is small. Consequently, frictional contact between the roller 53*e* of the lever 53 pressed by the pressing member 54*a* and the counteraction cam 51 is avoided, which reduces loss in the driving torque for rotating the camshaft 21 (22) attributable to the torque reducing mechanism 50*i* (50*e*) and improves fuel consumption.

A valve train 120 in a second embodiment of the present invention will be described with reference to FIGS. 7 and 8. A valve train 120 shown differs from the valve train 20 in construction relating to the intake camshaft and is basically the same as the valve train 20 in other respects. Therefore parts of the valve train 120 which are the same as those of the valve train 20 will be omitted or simplified and parts of the valve train 120 different from the valve train 20 will be described. Parts of the valve train 120 which are the same as or correspond to those of the valve train 20 in the first embodiment are designated by the same reference characters as the need arises.

Figure 7:
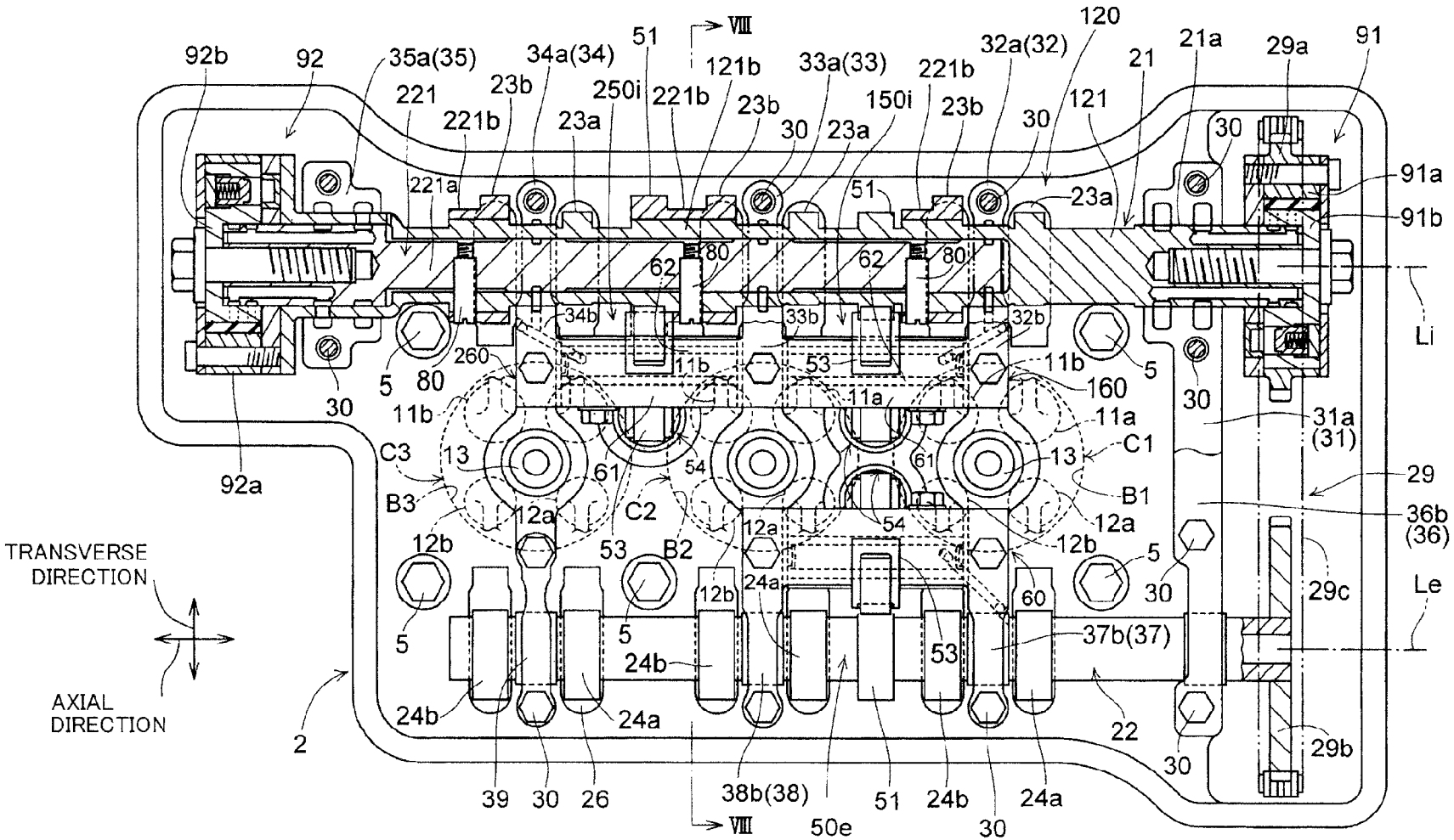
FIG. 7 is a plan view of an internal combustion engine provided with a valve train in a second embodiment of the present invention, in which an intake camshaft is shown in a longitudinal sectional view.
Figure 8:
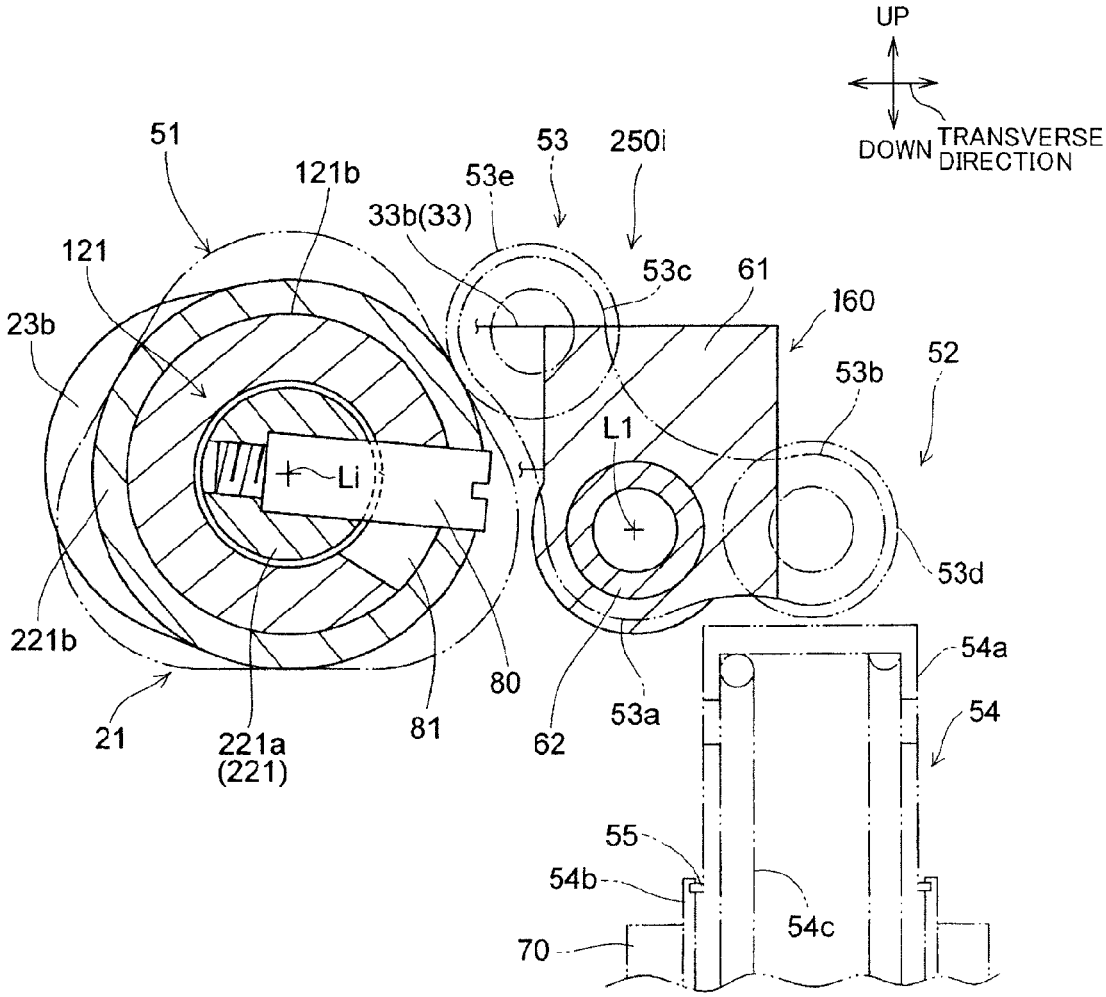
FIG. 8 is a sectional view of an important part of the internal combustion engine shown in FIG. 7 taken on the line VIII-VIII in FIG. 7.

Referring to FIGS. 7 and 8, the valve train 120 includes an intake camshaft 21 rotatably supported by intake camshaft supports 31 to 35, an exhaust camshaft 22 rotatably supported by exhaust camshaft supports 36 to 39, intake cams 23*a* and 23*b*, exhaust cams 24*a* and 24*b*, intake rocker arms 25, exhaust rocker arms 26, pivots, not shown, on which the rocker arms 25 and 26 turn, valve springs, not shown, constantly pushing the intake valves 11*a* and 11*b* and the exhaust valves 12*a* and 12*b* in closing directions, torque reducing mechanisms 150*i*, 250*i* and 50*e*, and phase control mechanisms 91 and 92 respectively for timing the opening and closing of the intake valves 11*a* and 11*b* according to the operating condition of the internal combustion engine. FIG. 7 shows lower bearing parts 31*a* to 35*a* of the intake camshaft supports 31 to 35.

The intake camshaft 21 is a double camshaft including an outer camshaft 121, namely, a first intake camshaft, and an inner camshaft 221, namely, a second intake camshaft. The outer camshaft 121 and the inner camshaft 221 can individually rotate about a center axis $L_i$. The inner camshaft 221 is inserted in the bore of the outer camshaft 121 coaxially with the outer camshaft 121.

The inner camshaft 221 has a shaft body 221*a* having a part received in the outer camshaft 121, and cam blocks 221*b* that rotates together with the body 221*a*. First intake cams 23*a* are formed integrally with the shaft body 221*a*, and second intake cams 23*b* are formed integrally with the camblocks 221*b*. The cam blocks 221*b* are fastened to the shaft body 221*a* with screws 80, namely, fastening members and are rotatably mounted on cam support parts 121*b* of the outer camshaft 121. The cam blocks 221*b* rotate together with the shaft body 221*a* and can turn relative to the cam support parts 121*b* of the outer shaft 121. Slots 81 (FIG. 8) are formed in the cam support parts 121*b*. The screws 80 are passed through the slots 81, respectively, and are screwed into the inner shaft camshaft 221. The sots 81 allow the outer camshaft 121 and the inner camshaft 221 to turn relative to each other.

The phase control mechanism 91, namely, a first phase control mechanism turns the outer camshaft 121. The phase control mechanism 92, namely, a second phase control mechanism, turns the inner camshaft 221. In the second embodiment, the phase control mechanisms 91 and 92 having the same basic construction are generally known hydraulic phase control mechanisms.

The first phase control mechanism 91 combined with the outer camshaft 121 has a body 91*a* integrally provided with a cam sprocket 29*a*, and a rotating member 91*b* received in the body 91*a* so as to be turnable relative to the body 91*a* and connected to the outer camshaft 121 so as to be rotatable together with the outer camshaft 121. The second phase control mechanism 92 combined with the inner camshaft 221 has a body 92*a* that rotates together with the outer camshaft 121, and a rotating member 92*b* combined with the body 92*a* so as to be turnable relative to the body 92*a*.

An ignition advance chamber and an ignition delay chamber are formed in each of the phase control mechanisms 91 and 92. A working fluid controlled by a controller is supplied into and discharged from the ignition advance chamber and the ignition delay chamber selectively to rotate the rotating members 91*b* and 92*b* relative to the bodies 91*a* and 92*a* to maintain or change the respective phases of the first intake cam 23*a* and the second intake cam 23*b*. Thus, the timing of the opening and closing operations of the first intake valve 11*a* and the second intake valve 11*b* is controlled.

The respective phases of the first intake cam 23*a* and the second intake cam 23*b* can be simultaneously changed by rotating the outer camshaft 121 and the inner camshaft 221 at the same time under the control of only the first phase control mechanism 91. The respective phases of the first intake cam 23*a* and the second intake cam 23*b* can be individually changed by rotating the outer camshaft 121 and the inner camshaft 221 individually under the control of both the first phase control mechanism 91 and the second control mechanism 92.

The torque reducing mechanisms 150*i* and 250*i* are the same in construction as the torque reducing mechanism 50*i* of the first embodiment.

The first torque reducing mechanism 150*i* for suppressing torque fluctuation that occurs in the outer camshaft 121 includes a counteraction cam 51 mounted on the outer camshaft 121, and a lever 53 supported for rocking on a support shaft 62 included in a first connecting member 160 connecting the axially adjacent two camshaft supports 32 and 33. The second torque reducing mechanism 250*i* for suppressing torque fluctuation that occurs in the inner camshaft 221 includes a counteraction cam 51 formed in a cam member 221*c*, and a lever 53 supported for rocking on a support shaft 62 included in a second connecting member 260 connecting the axially adjacent two camshaft supports 33 and 34. The camshaft support 33 is connected to both the connecting members 160 and 260.

The torque reducing mechanisms 150*i* and 250*i* of the second embodiment have the same operations and effects as the torque reducing mechanism 50*i* of the first embodiment and additionally have the following operations and effects.

The first torque reducing mechanism 150*i* suppresses torque fluctuation in the outer camshaft 121, the second torque reducing mechanism 250*i* suppresses torque fluctuation in the inner camshaft 221 to facilitate the phase control of the intake cams by the first phase control mechanism 91 and the second phase control mechanism 92, which contributes to the improvement of the accuracy and response characteristics of the control operations of the phase control mechanisms 91 and 92.

A valve train 20 in a third embodiment of the present invention will be described with reference to FIGS. 9 to 12. The valve train 20 in the third embodiment differs from the valve train 20 in the first embodiment in shape and arrangement of component parts of a torque reducing mechanism and is the same as the valve train 20 in the first embodiment in function and is basically same as the valve train 20 in the first embodiment in other respects. Therefore parts of the valve train 20 in the third embodiment which are the same as those of the valve train 20 in the first embodiment will be omitted or simplified, and parts of the valve train 20 in the third embodiment different from the valve train 20 in the first embodiment will be described. Parts of the valve train 20 in the third embodiment which are the same as or correspond to those of the valve train 20 in the first embodiment are designated by the same reference characters as the need arises.

Since torque reducing mechanisms 350*i* and 350*e* are the same in basic construction, only the intake torque reducing mechanism 350*i* will be mainly described. Parts and reference characters necessary for the description of the exhaust torque reducing mechanism 350*e* will be shown in parentheses as the need arises.

Figure 9:
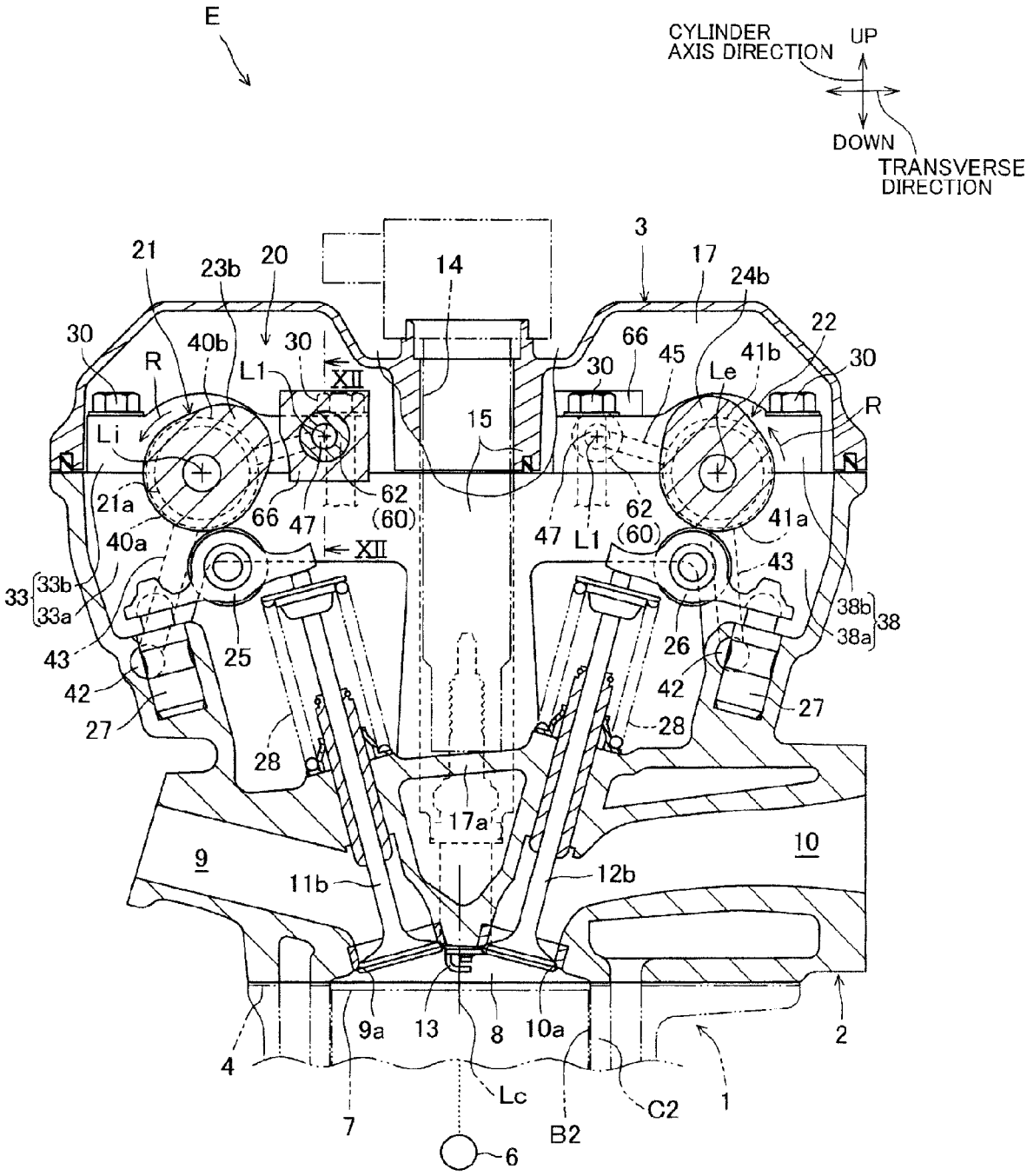
FIG. 9 is a cross-sectional view of an important part of an internal combustion engine provided with a valve train in a third embodiment of the present invention.
Figure 10:
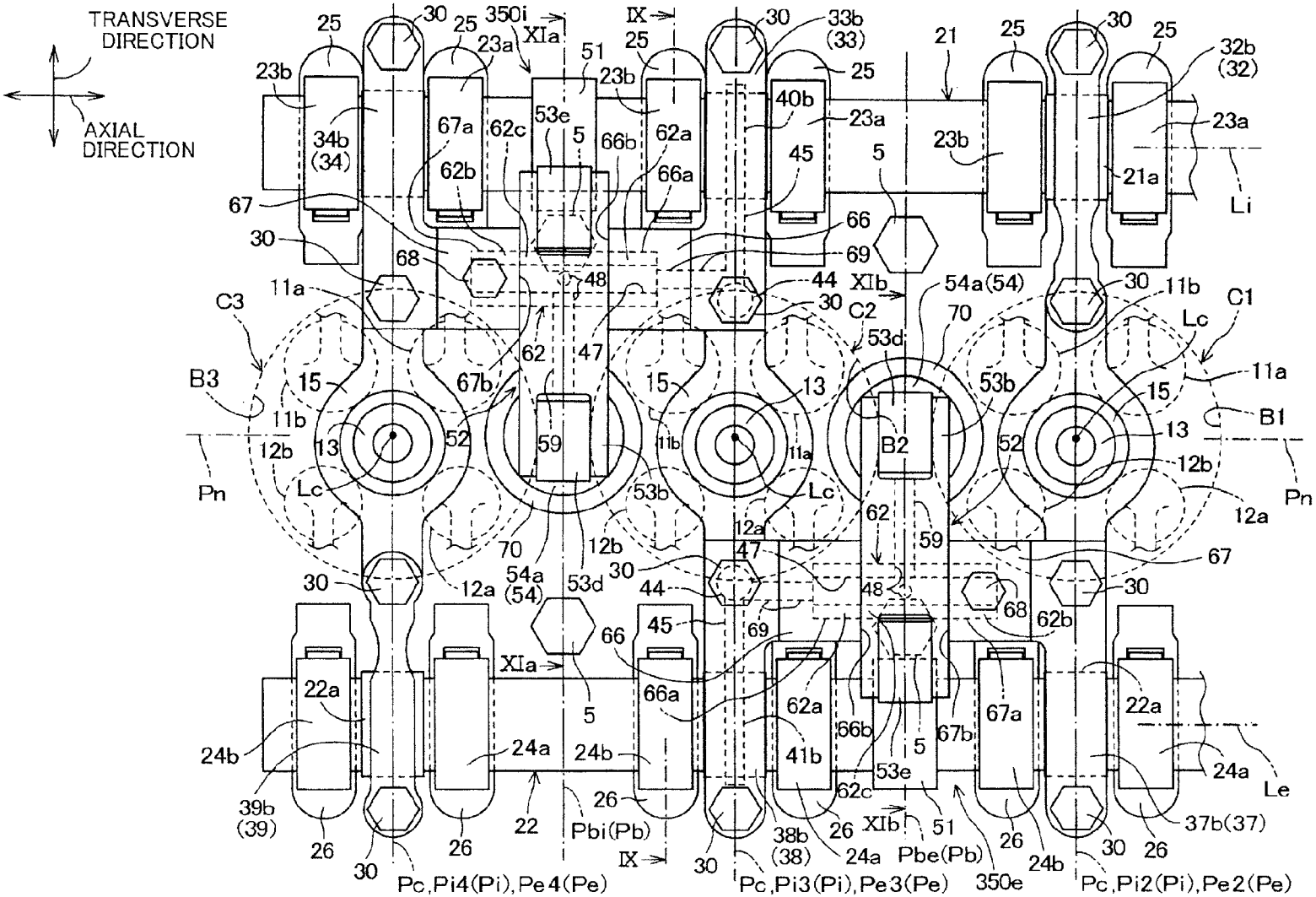
FIG. 10 is an enlarged plan view of an important part of the internal combustion engine shown in FIG. 9.
Figure 11:
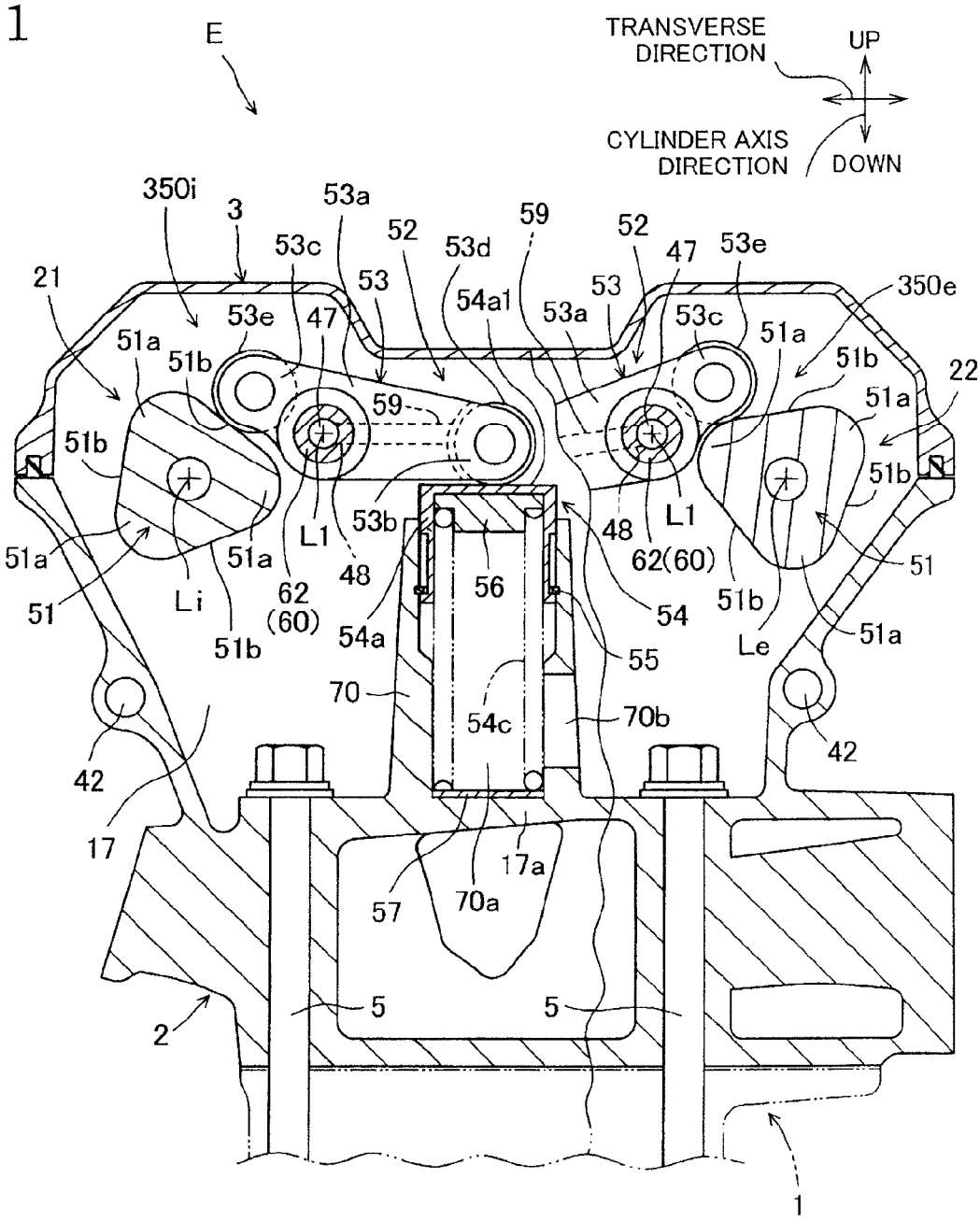
FIG. 11 is a sectional view of an important part of the intake part of the internal combustion engine shown in FIG. 10 taken on the line XIa-XIa in FIG. 10, and an important part of the exhaust part of the internal combustion engine shown in FIG. 10 taken on the line XIb-XIb in FIG. 10.

Referring to FIGS. 9 to 11, the torque reducing mechanism 350*i* (350*e*) includes a counteraction cam 51, a counterforce applying mechanism 52 and a snap ring 55, which are the same as those of the torque reducing mechanism 50*i* (50*e*) of the first embodiment. The counterforce applying mechanism 52 includes a lever 53 supported for rocking on a support shaft 62, and a pressing device 54 operatively combined with the lever 53. The support shaft 62 serves also as a connecting member 69.

The lever 53 has a fulcrum part 53*a* through which the support shaft 62 extends to support the lever 53 for turning thereon, an input arm 53*b* provided with a roller 53*d*, and an output arm 53*c* provided with a roller 53*e*. In this embodiment, the arm length ratio, namely, the ratio of the effective length of the output arm 53*c* to that of the input arm 53*b*, is approximately ½ or not higher than ½ as shown in FIG. 11.

The pressing device 54 includes a cylindrical pressing member 54*a* having an top wall 54*a*1 to be pressed against the roller 53*d*, a compression coil spring 54*c* extended in a bore 70*a* of a holding protrusion 70 formed integrally with the cylinder head 2, and a weight 56 placed inside the pressing member 54*a* so as to be pressed against the top wall 54*a*1 by the compression coil spring 54*c*.

The compression coil spring 54*c* is extended between the pressing member 54*a* and a flat spring seat 57 placed on the cylinder head 2.

The weight 56 increases the inertial mass of the pressing member 54*a* to maintain the pressing member 54*a* in contact with the roller 53*d*. Thus, the weight 56 prevents the temporary interruption of the action of the force $F_a$ on the roller 53*d* due to the formation of a gap between the roller 53*d* and the top wall 54*a*1 caused by shocks imparted through the counteraction cam 51 and the lever 53 to the pressing member 54*a* by the reaction forces of the intake valves 11*a* and 11*b* (the exhaust valves 12*a* and 12*b*) at the start of the action of the reaction forces and prevents the generation of attack sound when the roller 53*d* once separated from the top wall 54*a*1 comes into contact again with the top wall 54*a*1. The weight 56 stabilizes the application of the counter torque produced by the force $F_a$ to the counteraction cam 51, which improves the torque fluctuation suppressing effect of the torque reducing mechanism 350*i* (350*e*). The pressing member 54*a* and the weight 56 that moves together with the pressing member 54*a* are separate members. Therefore, the pressing member 54*a* can be used as a common part for internal combustion engines of different types, and different weights 56 can be used for internal combustion engines of different types, respectively. The weight 56 may be formed integrally with the pressing member 54*a*1.

A discharge port 70*b* is formed in a lower part of the holding protrusion 70 extending upward from a bottom wall 17*a*. The oil flowing into the bore 70*a* is discharged through the discharge port 70*b* into the valve chamber 17.

A snap ring 55 is fitted in an annular groove formed in the inside surface of the holding protrusion 70 to determine the highest position of the pressing member 54*a* as shown in FIG. 11.

The lever 53 is supported for rocking about a pivot axis L1 on a support shaft 62 extended between and detachably attached to the upper bearing parts 33*b* and 34*b* (37*b* and 38*b*) of the axially adjacent two camshaft supports 33 and 34 (37 and 38). The support shaft 62 is located nearer to the center plane $P_n$ of the internal combustion engine E than the camshaft 21 (22) with respect to the transverse direction. The support shaft 62 is between the camshaft 21 (22) and a cylindrical wall 15 with respect to the transverse direction.

Figure 12:
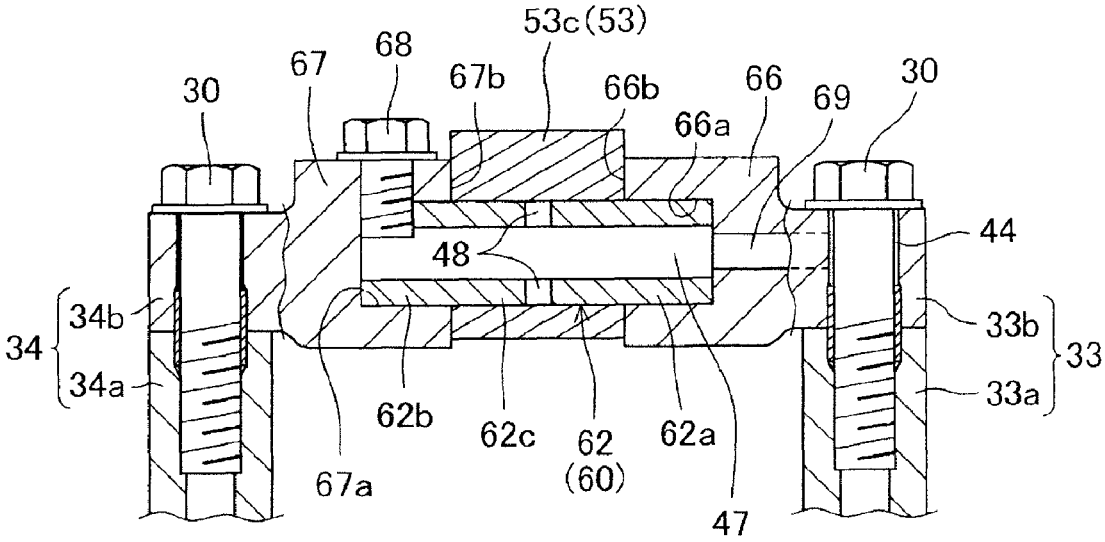
FIG. 12 is a sectional view of an important part of the internal combustion engine taken on the line XII-XII in FIG. 9.

As shown in FIG. 12, supported end parts 62*a* and 62*b* of the support shaft 62 are held by support parts 66 and 67 formed integrally with the upper bearing parts 33*b* and 34*b* (37*b* and 38*b*). The support shaft 62 is fixed immovably to the support part 67 with a screw 68, namely, a fixing means. The end parts 62*a* and 62*b* are inserted in holes 66*a* and 67*a* formed in the support parts 66 and 67, respectively. The lever 53 is supported for rocking about the pivot axis L1 on a support part 62*c* extending between the support parts 66 and 67. In a modification, the support parts 66 and 67 may be formed integrally with the lower bearing parts 33*a* and 34*a* (37*a* and 38*a*), at least either of the support parts 66 and 67 may be formed separately from and connected to the corresponding one of the bearing parts 33 and 34 (37 and 38). The end parts 62*a* and 62*b* may be supported rotatably on the support parts 66 and 67, respectively.

The upper bearing parts 33*b* and 34*b* (37*b* and 38*b*) are axially separated from each other and the support parts 66 and 67 extend axially toward each other. In this embodiment, the respective axial lengths of the support parts 66 and 67 are equal. The support parts 66 and 67 may have different axial length, respectively. In a modification, the support part 66 (67) may extend toward the support part 67 (66), and the support part 67 (66) does not extend toward the support part 66 (67). When the support parts 66 and 67 have different lengths, respectively, or one of the support parts 66 and 67 extends toward the other, the axial position of the lever 53 can be changed so as to meet the condition of parts arranged around the lever 53. The degree of freedom of determining the axial position of the lever 53 can be increased.

The support shaft 62 is provided with oil passages 47 and 48. The oil flows from an oil groove 40*b* (41*b*) formed in the upper bearing part 33*b* (38*b*) through an oil passage 45 formed in the upper bearing part 33*b* (38*b*), namely, an oiling bearing part, and an oil passage 69 formed through the upper bearing part 33*b* (38*b*) and the support part 66, namely, an oiling support part, into the oil passages 47 and 48. The outlet of the oil passage 45 opens into an oil passage 44 formed in a threaded hole into which a bolt 30 is screwed. The inlet of the oil passage 60 opens into the oil passage 44. In this embodiment, a part of the inlet of the oil passage 69 opens into the oil passage 45. The inlet of the oil passage 69 may entirely open into the oil passage 44.

The oil flows from the oil groove 40*b* (41*b*) through the oil passages 45, 44 and 69 into the oil passage 47, namely, the bore of the support shaft 62. The oil is delivered from the oil passage 47 extending along the pivot axis L1 through the oil passages 48 radially penetrating the support shaft 62 to the sliding parts of the support shaft 62 and the fulcrum part 53*a* of the lever 53.

Use of the oil passage 44 formed in the vertical threaded hole for delivering the oil to the oil passage 47 increases the degree of freedom of determining the position of the support shaft 62 provided with the oil passage 47 with respect to the vertical direction. Thus, the internal combustion engine E can be formed in a small vertical dimension by disposing the support shaft 62 at a lower position or near the bottom wall 17*a*.

The oil flowing from the oil passage 47 into the oil passages 48 drips into the valve chamber 17 after lubricating the sliding parts of the support shaft 62 and the fulcrum part 53*a* and the sliding parts of the fulcrum part 53*a* and the respective end surfaces 66*b* and 67*b* of the support parts 66 and 67.

The oil flowing from the oil passages 48 into an oil passage 59 extending in the input arm 53*b* from the fulcrum part 53*c* toward the roller 53*d* is spurted toward the roller 53*d* or the top wall 54*a*1 of the pressing member 54*a* to lubricate contact parts of the roller 53*d* and the top wall 54*a*1. Part of the oil that has lubricated the contact parts flows through a gap between the pressing member 54*a* and the holding protrusion 70 into the bore 70*a* to lubricate the sliding parts of the pressing member 54*a* and the holding protrusion 70. The oil that has flowed into the bore 70*a* lubricates parts of the holding protrusion 70, the pressing member 54*a* and the spring seat 57 in contact with the compression coil spring 54*c* that is compressed and expanded. Then the oil is discharged from the bore 70*a* through the oil discharge port 70*b* into the valve chamber 17.

Referring to FIG. 10, the intake camshaft torque reducing mechanism 350*i* is disposed between the axially adjacent cylinder bores B2 and B3, while the exhaust camshaft torque reducing mechanism 305*e* is disposed between the axially adjacent cylinder bores B1 and B2. In other words, the counteraction cam 51, the lever 53, the pressing member 54*a* and the compression coil spring 54*c* included in the intake camshaft torque reducing mechanism 350*i*, and the holding protrusion 70 holding the pressing member 54*a* of the intake camshaft torque reducing mechanism 350*i* are contained in an interbore plane $Pb_i$ between the cylinder bores B2 and B3, while the counteraction cam 51, the lever 53, the pressing member 54*a* and the compression coil spring 54*c* included in the exhaust camshaft torque reducing mechanism 350*e*, and the holding protrusion 70 holding the pressing member 54*a* of the exhaust camshaft torque reducing mechanism 350*e* are contained in an interbore plane $Pb_e$ between the cylinder bores B1 and B2.

The lever 53, the support shaft 62, the pressing member 54*a* and the compression coil spring 54*c* included in the intake camshaft torque reducing mechanism 350*i*, and the holding protrusion 70 holding the pressing member 54*a* of the intake camshaft torque reducing mechanism 350*i* are at an axial position between the camshaft supports 33 and 34 connecting the support shaft 62, while the lever 53, the support shaft 62, the pressing member 54*a* and the compression coil spring 54*c* included in the exhaust camshaft torque reducing mechanism 350*e* and the holding protrusion 70 holding the pressing member 54*a* of the exhaust camshaft torque reducing mechanism 350*e* are at an axial position between the camshaft supports 37 and 38 connecting the support shaft 62.

Thus the axial positions of the intake and exhaust camshaft torque reducing mechanisms 350*i* and 350*e* are offset or different.

Therefore, the intake camshaft torque reducing mechanism 350*i* and the holding protrusion 70 holding the pressing member 54*a* of the intake camshaft torque reducing mechanism 350*i*, and the exhaust camshaft torque reducing mechanism 350*e* and the holding protrusion 70 holding the pressing member 54*a* of the exhaust camshaft torque reducing mechanism 350*e* are at an axial position between the camshaft supports 33 and 34 and an axial position between the camshaft supports 37 and 38 (or between the camshaft supports 38 and 39 and the camshaft supports 32 and 33), respectively, or at an axial position between a pair of support planes $P_{i3}$ and $P_{i4}$ and at an axial position between a pair of support planes $P_{e2}$ and $P_{e3}$ (or at an axial position between the support planes $P_{e3}$ and $P_{e4}$ and at an axial position between the support planes $P_{i2}$ and $P_{i3}$, respectively.

The counteraction cam 51, the lever 53, the pressing member 54*a* and the compression coil spring 54*c* of the intake camshaft torque reducing mechanism 350*i* and the holding protrusion 70 holding the pressing member 54*a* of the intake camshaft torque reducing mechanism 350*i*, and the counteraction cam 51, the lever 53, the pressing member 54*a* and the compression coil spring 54*c* of the exhaust camshaft torque reducing mechanism 350*e* and the holding protrusion 70 holding the pressing member 54*a* of the exhaust camshaft torque reducing mechanism 350*e* are substantially symmetrical with respect to the axis $L_c$ of the cylinder C2.

The pressing members 54*a*, the compression coil springs 54*c*, the rollers 53*d* and the holding protrusions 70 are arranged between the intake camshaft 21 and the exhaust camshaft 22 with respect to the transverse direction and are arranged in a direction perpendicular to the center plane $P_n$ of the internal combustion engine E. In this embodiment, the respective centers of the pressing members 54*a*, the compression coil springs 54*c* and the holding protrusions 70 are arranged substantially on or near the center plane $P_n$.

Referring to FIGS. 9 and 11, at least some parts of the counteraction cam 51, the pressing member 54*a* and the compression coil spring 54*c* of the pressing device 54, and the holding protrusion 70 are at the same position with respect to the vertical direction, namely, the first direction and at least some parts of the same overlap each other with respect to the vertical direction. More concretely, the top wall 54*a*1 is at substantially the same position with the center axis of the counteraction cam 51 aligned with the center axis $L_i$ ($L_e$) of the camshaft 21 (22) with respect to the vertical direction when the pressing member 54*a* is at the highest position. The pressing member 54*a*, the compression coil spring 54*c* and the holding protrusion 70 correspond to a lower part of the counteraction cam 51 and overlap a lower half of the counteraction cam 51 with respect to the vertical direction when the pressing member 54*a* is at the highest position. In a modification, the pressing member 54*a*, the compression coil spring 54*c* and the holding protrusion 70 may correspond to a lower part of the counteraction cam 51 and may overlap most part of the counteraction cam 51 with respect to the vertical direction when the pressing member 54*a* is at the highest position.

As shown in FIGS. 10 and 11, the pivot axis L1 of the lever 53 and the support shaft 62 are disposed between the counteraction cam 51 and the pressing member 54*a* of the pressing device 54 with respect to the transverse direction, namely, the second direction, perpendicular to the vertical direction.

The support shaft 62, the pivot axis L1, the pressing member 54*a*, the compression coil spring 54*c* and the holding protrusion 70 are below the level of the highest position that the counteraction cam 51 can reach and the level of the highest position that the lever 53 can reach. Since most lower part of the lever 53 is below the level of the highest position that the counteraction cam 51 can reach, the lever 53 does not greatly protrude from the counteraction cam 51.

Therefore, the support shaft 62, the pressing member 54*a*, the compression coil spring 54*c* and the holding protrusion 70 are lower than the counteraction cam 51. Since the lever 53 can be disposed at a position lower than the counteraction cam 51 with respect to the vertical direction in the valve chamber 17, the torque reducing mechanisms 350*i* and 350*e* do not increase the vertical dimension of the internal combustion engine E.

The torque reducing mechanisms 350*i* and 350*e* of the third embodiment have the following operations and effect, in addition to operations and effect relating to the torque fluctuation suppression equal to those of the torque reducing mechanisms 50*i* and 50*e* of the first embodiment.

The connecting member 60 connecting the axially adjacent two camshaft supports 33 and 34 (37 and 38) and supporting the lever 53 is the support shaft 62 supported by the support parts 66 and 67 of the camshaft supports 33 and 34 (37 and 38) axially separated from each other with respect to the axial direction, the lever 53 is supported for rocking on the support shaft 62 at the position between the support parts 66 and 67, and the support shaft 62 connects the axially separate camshaft supports 33 and 34 (37 and 38). Therefore, as compared with a state where two adjacent camshaft supports are connected by the connecting member formed integrally with the two adjacent camshaft supports, the engine E can be made of light weight and the position of the lever 53 is not restricted by the connecting member, and hence the degree of freedom of determining the position of the lever 53 and the degree of freedom of designing the shape of the lever 53 increase. Consequently, the lever 53 can be disposed with its upper end part located close to the counteraction cam 51 with respect to the vertical direction even in a state where the top wall 54*a*1 of the pressing member 54*a* of the pressing device 54 is close to the center axis $L_i$ ($L_e$) of the camshaft 21 (22) with respect to the vertical direction, and hence the torque reducing mechanism 350*i* (350*e*) can be formed in a small dimension with respect to the vertical direction and the internal combustion engine E can be formed in small dimensions with respect to the vertical direction.

Since at least one of the adjacent support parts 66 and 67 extends toward the other, the axial distance between the pair of support parts 66 and 67 can be reduced and hence the rigidity of the support shaft 62 supporting the lever 53 at a position between the support parts 66 and 67 can be enhanced. The position of the lever 53 on the support shaft 62 can be changed by changing the axial extending lengths of the support parts 66 and 67. Thus, the degree of freedom of determining the position of the lever 53 with respect to the axial direction is large. When the pair of support parts 66 and 67 extend axially toward each other, the torque reducing mechanism 350*i* (350*e*) can be contained in the interbore plane $P_{bi}$ ($P_{be}$) at a position in a readily available space in the valve chamber 17.

At least some parts of the counteraction cam 51, the pressing member 54*a* and the compression coil spring 54*c* of the pressing device 54 are at the same position with respect to the vertical direction as viewed in the direction parallel to the center axis $L_i$ ($L_e$) of the camshaft 21 (22), and the pivot axis L1 of the lever 53 and the support shaft 62 are disposed between the counteraction cam 51 and the pressing device 54 with respect to the transverse direction perpendicular to the vertical direction. Therefore, the pressing device 54 for applying the force $F_a$ to the lever 53 and the counteraction cam 51 with which the lever 53 comes into contact overlap each other with respect to the vertical direction. Since the pivot axis L1 of the lever 53 is between the pressing device 54 and the counteraction cam 51 with respect to the transverse direction, the lever 53 can be formed in small size with respect to the vertical direction parallel to the axes of the cylinders, and hence the internal combustion engine E can be formed in small size with respect to the vertical direction.

The intake camshaft torque reducing mechanism 350*i* and the exhaust camshaft torque reducing mechanism 350*e* are disposed respectively at different positions with respect to the direction parallel to the respective center axes of the intake camshaft 21 and the exhaust camshaft 22; that is, the intake camshaft torque reducing mechanism 350*i* and the exhaust camshaft torque reducing mechanism 350*e* are disposed between the camshaft supports 33 and 34 and between the camshaft supports 37 and 38 (or between the camshaft supports 38 and 39 and between the camshaft supports 32 and 33), respectively. with respect to the axial direction. Since the intake camshaft torque reducing mechanism 350*i* and the exhaust camshaft torque reducing mechanism 350*e* are disposed between the camshaft supports 33 and 34 and between the camshaft supports 37 and 38 at positions different from those of the camshaft supports 33 and 34 with respect to the axial direction, the exhaust camshaft torque reducing mechanism 350*e* does not place any restriction on the position of the intake camshaft torque reducing mechanism 350*i* between the camshaft supports 33 and 34 (or 38 and 39) with respect to the axial direction in the space between the intake camshaft 21 and the exhaust cam shaft 22. Similarly, the intake camshaft torque reducing mechanism 350*i* does not place any restriction on the position of the exhaust camshaft torque reducing mechanism 350*e* between the camshaft supports 37 and 38 (or 32 and 33) with respect to the axial direction in the space between the intake camshaft 21 and the exhaust cam shaft 22. Thus, the degree of freedom of determining the respective positions of the intake camshaft torque reducing mechanism 350*i* and the exhaust camshaft torque reducing mechanism 350*e* in the space between the intake camshaft 21 and the exhaust camshaft 22 is large. Moreover, a high counter torque can be produced by a low force $F_a$ produced by the pressing device 54 by properly determining the leverage of the lever 53 without increasing the size of the internal combustion engine E.

Parts of valve trains in modifications of the foregoing embodiments different from those of the foregoing embodiments will be described.

In a valve train including a plurality of camshafts, a torque reducing mechanism may be combined with at least one of the camshafts.

A valve train may be a SOHC type valve train provided with a single camshaft provided with intake cams and exhaust cams.

Although the lever 53, namely, a component member of the counterforce applying mechanism 52, is supported for rocking by the connecting member 60 in the foregoing embodiments, the other component members of the counterforce applying mechanism may be formed integrally and the entire counterforce applying mechanism may be fixedly held by the connecting member.

The pressing device may be an electric or hydraulic actuator capable of producing a periodically varying force.

The number of the cam lobes of one counteraction cam may be equal to that of cams mounted on one camshaft. One camshaft may be provided with a plurality of counteraction cams.

Only either of the outer cam shaft and the inner camshaft of the double-shaft type camshaft of the second embodiment may be controlled by the phase control mechanism. In a valve train including a phase control mechanism, the phase of one camshaft may be changed by one phase control mechanism.

In the third embodiment, most part of the pressing member 54*a*, the compression coil spring 54*c*, the roller 53*d* and the holding protrusion 70 with respect to the transverse direction may be disposed opposite to the counteraction cam 51 with respect to the center plane $P_n$ of the internal combustion engine E. When the pressing member 54*a*, the compression coil spring 54*c*, the roller 53*d* and the holding protrusion 70 are thus arranged, the distance between the support shaft 62 and the roller 53*d* with respect to the transverse direction is increased and the lever ratio of the lever 53 can be diminished still further; that is, the same counter torque can be produced by a force lower than the force $F_a$ or an increased counter torque can be produced by the same force $F_a$.

The camshafts may be supported in rolling bearings or sliding bearings on the camshaft supports.

The counteraction cam and the camshaft may be separately made and the counteraction cam may be mounted on the camshaft.

Although the intake and exhaust torque reducing mechanisms are disposed between the same pair of adjacent cylinder bores in each of the foregoing embodiments, intake and exhaust torque reducing mechanisms may be disposed between different pairs of adjacent cylinder bores, respectively.

The input and output arms of the lever may be at different positions, respectively, with respect to the axial direction. Such an arrangement of the input and output arms increases the degree of freedom of determining the respective positions of the input and output arms with respect to the axial direction and the degree of freedom of determining the respectively positions of the arm and the pressing device.

The lever of the counterforce applying mechanism may be omitted and the counterforce applying mechanism may apply the counter torque to the camshaft by applying the counterforce directly or indirectly through an intermediate member to the counteraction cam by the pressing device.

The intake and exhaust torque reducing mechanisms of the first embodiment, similarly to the intake and exhaust torque reducing mechanisms, maybe disposed between the pair of intake camshaft supports and the pair of exhaust camshaft supports at positions different from those of the pair of intake camshaft supports, respectively.

The internal combustion engine E may be a V-6 internal combustion engine having two banks each provided with three cylinders, a multiple-cylinder internal combustion engine other than 3-cylinder and V-6 internal combustion engines or a single-cylinder internal combustion engine.

Although the description of the embodiments has been made on an assumption that the internal combustion engine is for a vehicle, the internal combustion engine may be a ship propulsion engine, such as an outboard motor having a vertical crankshaft or the like.

What is claimed is:

1. A valve train for an internal combustion engine, comprising:

a plurality of camshaft supports arranged on a support member included in the internal combustion engine;

a camshaft supported on the camshaft supports and provided with valve operating cams for opening and closing engine valves included in the internal combustion engine; and a torque reducing mechanism for applying a counter torque to the camshaft to suppress torque fluctuation of the camshaft caused by reaction forces applied to the cams by the engine valves;

wherein the torque reducing mechanism includes a rotating member that rotates together with the camshaft, and a counterforce applying member for applying a counterforce to the rotating member to apply a counter torque to the camshaft, and the counterforce applying member is supported on a connecting member connecting adjacent ones of the camshaft supports;

wherein the counterforce applying member is a lever supported for rocking on the connecting member, the lever has an input arm and an output arm that rocks together with the input arm, a pressing device is provided to produce a force to be applied to the lever to press the lever against the rotating member, and the pressing device applies the force to the input arm such that the output arm is pressed against the rotating member to apply a counterforce to the rotating member.

2. The valve train for an internal combustion engine according to claim 1, wherein the input arm and the output arm are arranged such that the output arm applies the counterforce to the rotating member in a direction different from a direction in which the force is applied to the input arm.

3. The valve train for an internal combustion engine according to claim 1, wherein the adjacent camshaft supports are spaced apart with respect to an axial direction in which the axis of the camshaft extends, the connecting member extends parallel to the axis of the camshaft to connect the adjacent camshaft supports, the connecting member has a support shaft extending between the adjacent camshaft supports, and the lever is supported for rocking on the support shaft.

4. The valve train for an internal combustion engine according to claim 1, wherein the adjacent camshaft supports are spaced apart with respect to an axial direction in which the axis of the camshaft extends, a pair of support parts facing opposite to each other with respect to the axial direction are formed on the adjacent camshaft supports, respectively, the support shaft is extended between and fixed to the support parts, and the lever is supported for rocking on the support shaft.

5. The valve train for an internal combustion engine according to claim 4, wherein at least one of the support parts facing each other with respect to the axial direction extends toward the other.

6. The valve train for an internal combustion engine according to claim 1, wherein the rotating member and the pressing device are disposed so as to overlap each other at least partly with respect to the direction of the axis of the camshaft, the lever has an axis about which the lever rocks and which is located between the pressing device and the rotating member with respect to a second direction perpendicular to the axis of the camshaft.

7. The valve train for an internal combustion engine according to claim 1, wherein the internal combustion engine has a plurality of cylinders arranged in a direction parallel to the axis of the camshaft, the lever and the pressing device are disposed between adjacent ones of the cylinders with respect to a direction in which the axis of the camshaft extends, and the pressing device is disposed closer to the cylinders with respect to a direction in which axes of the cylinders extend than the axis of the camshaft.

8. The valve train for an internal combustion engine according to claim 1, wherein the support member is a cylinder head fastened to a cylinder block included in the internal combustion engine with a plurality of fastening bolts, and the pressing device is disposed between adjacent fastening bolts forming a pair and is supported on the cylinder head, such that the pressing device presses the cylinder head in a direction in which the fastening bolts apply tightening force to the cylinder head.

9. A valve train for an internal combustion engine having a support member, comprising:

an intake valve and an exhaust valve included in the internal combustion engine;

an intake camshaft for opening and closing the intake valve;

an exhaust cam shaft for opening and closing the exhaust valve and extending parallel to the intake camshaft;

a plurality of intake camshaft supports placed on a support member of the engine and supporting the intake camshaft;

a plurality of exhaust camshaft supports placed on the support member of the engine and supporting the exhaust camshaft;

an intake camshaft torque reducing mechanism for applying a counter torque for suppressing torque fluctuation of the intake camshaft resulting from reaction forces applied to the intake camshaft by the intake valve; and an exhaust camshaft torque reducing mechanism for applying a counter torque for suppressing torque fluctuation of the exhaust camshaft resulting from reaction forces applied to the exhaust camshaft by the exhaust valve;

wherein the intake camshaft torque reducing mechanism includes an intake rotating member that rotates together with the intake camshaft, and an intake counterforce applying member for applying a counterforce to the intake rotating member to apply a counter torque to the intake camshaft, the intake counterforce applying member is supported by an intake connecting member connecting adjacent ones of the intake camshaft supports forming a pair, the exhaust camshaft torque reducing mechanism includes an exhaust rotating member that rotates together with the exhaust camshaft, and an exhaust counterforce applying member for applying a counterforce to the exhaust rotating member to apply a counter torque to the exhaust camshaft, the exhaust counterforce applying member is supported by an exhaust connecting member connecting the adjacent exhaust camshaft supports forming a pair, the intake camshaft torque reducing mechanism is disposed between the adjacent intake camshaft supports, and the exhaust camshaft torque reducing mechanism is disposed between the adjacent exhaust camshaft supports at positions different from those of the adjacent intake camshaft supports with respect to a direction in which the respective axes of the intake camshaft and the exhaust camshaft extend.

10. A valve train for an internal combustion engine, comprising a plurality of camshaft supports arranged on a support member included in the internal combustion engine, a camshaft supported on the camshaft supports and provided with valve operating cams for opening and closing engine valves included in the internal combustion engine, a torque reducing mechanism for applying a counter torque to the camshaft to suppress torque fluctuations of the camshaft caused by reaction forces applied to the cams by the engine valves;

wherein the torque reducing mechanism includes a rotating member that rotates together with the camshaft, and a counterforce applying member for applying a counterforce to the rotating member to apply a counter torque to the camshaft, the counterforce applying member is supported on a connecting member connecting adjacent ones of the camshaft supports, wherein the counterforce applying member is pressed against the rotating member to apply a counterforce to the rotating member, and the torque reducing mechanism is provided with a stopping means for preventing the counterforce applying member from applying the counterforce to the rotating member when variation of the torque of the camshaft is not higher than a predetermined value.

11. A valve train for an internal combustion engine, comprising a plurality of camshaft supports arranged on a support member included in the internal combustion engine, a camshaft supported on the camshaft supports and provided with valve operating cams for opening and closing engine valves included in the internal combustion engine, a torque reducing mechanism for applying a counter torque to the camshaft to suppress torque fluctuations of the camshaft caused by reaction forces applied to the cams by the engine valves;

wherein the torque reducing mechanism includes a rotating member that rotates together with the camshaft, and a counterforce applying member for applying a counterforce to the rotating member to apply a counter torque to the camshaft, the counterforce applying member is supported on a connecting member connecting adjacent ones of the camshaft supports, wherein the camshaft having the valve operating cams includes an outer camshaft and an inner camshaft extended in the outer camshaft for rotation relative to the outer camshaft, and the outer camshaft and the inner camshaft are connected to phase control mechanisms, respectively.

* * * * *